US009981168B2

(12) United States Patent
Ines et al.

(10) Patent No.: US 9,981,168 B2
(45) **Date of Patent: *May 29, 2018**

(54) SUPPORTED IRON SET

(71) Applicant: Acushnet Company, Fairhaven, MA (US)

(72) Inventors: Marni D. Ines, San Marcos, CA (US); Jonathan Hebreo, San Diego, CA (US)

(73) Assignee: Acushnet Company, Fairhaven, MA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/609,993

(22) Filed: May 31, 2017

(65) Prior Publication Data

US 2017/0259134 A1 Sep. 14, 2017

Related U.S. Application Data

(63) Continuation-in-part of application No. 14/688,056, filed on Apr. 16, 2015, now Pat. No. 9,718,119, which is a continuation-in-part of application No. 14/626,526, filed on Feb. 19, 2015, now Pat. No. 9,427,635, which is a continuation-in-part of application No. 13/887,701, filed on May 6, 2013, now Pat. No. 8,998,742.

(51) Int. Cl.

| | |
|---|---|
| ***A63B 53/04*** | (2015.01) |
| *A63B 53/00* | (2015.01) |
| *A63B 102/32* | (2015.01) |

(52) U.S. Cl.
CPC ..... *A63B 53/047* (2013.01); *A63B 53/0475* (2013.01); *A63B 2053/005* (2013.01); *A63B 2053/0416* (2013.01); *A63B 2053/0433* (2013.01); *A63B 2053/0491* (2013.01); *A63B 2102/32* (2015.10)

(58) Field of Classification Search
CPC ..... A63B 53/047; A63B 2053/005; A63B 2053/0491; A63B 2053/0416; A63B 2053/0433; A63B 2102/32; A63B 53/0475
See application file for complete search history.

(56) References Cited

U.S. PATENT DOCUMENTS

| | | | |
|---|---|---|---|
| 4,645,207 | A | 2/1987 | Teramoto |
| 4,754,971 | A | 7/1988 | Kobayashi |
| 4,874,171 | A | 10/1989 | Ezaki et al. |
| 5,295,686 | A | 3/1994 | Lundberg |
| 5,333,872 | A | 8/1994 | Manning |
| 5,472,203 | A | 12/1995 | Schmidt |
| 5,524,880 | A | 6/1996 | Kobayashi |
| 5,547,426 | A | 8/1996 | Wood |

(Continued)

FOREIGN PATENT DOCUMENTS

| | | |
|---|---|---|
| JP | 3130167 | 3/2007 |

*Primary Examiner* — Stephen Blau

(57) ABSTRACT

The present invention is directed to a set of golf clubs comprising long irons, mid irons and short irons. The irons have a progressive horizontal CG location. Preferably, the long and mid irons have a face stabilizing bar and back panel and the CG is located between about 1 mm and 3 mm towards the hosel and the CG in the short irons is located between about 3 mm and 4 mm toward the hosel. Further the long and mid irons irons can have a plurality of apertures in the face stabilizing bar and/or the back wall.

18 Claims, 14 Drawing Sheets

(56) References Cited

U.S. PATENT DOCUMENTS 5,669,825 A 9/1997 Shira
5,669,826 A 9/1997 Chang
5,722,900 A 3/1998 Sung
5,771,552 A 6/1998 Karner
5,833,551 A 11/1998 Vincent
5,935,020 A 8/1999 Stites et al.
5,984,803 A 11/1999 Chappell
6,089,990 A 7/2000 Kimura
6,290,607 B1 9/2001 Gilbert et al.
6,482,104 B1 11/2002 Gilbert
6,561,921 B2 5/2003 Takeda
6,602,147 B2 8/2003 Shiraishi
6,623,374 B1 9/2003 Vincent
6,660,960 B2 12/2003 Takeda
6,780,123 B2 * 8/2004 Hasebe ..... A63B 53/04 473/291
6,860,819 B2 3/2005 Gilbert
6,932,717 B2 8/2005 Hou
7,014,568 B2 3/2006 Pelz
7,022,028 B2 4/2006 Nagai
7,137,903 B2 * 11/2006 Best ..... A63B 53/047 473/290
7,186,187 B2 3/2007 Gilbert et al.
7,235,023 B2 6/2007 Sugimoto
7,513,835 B2 4/2009 Belmont
7,559,850 B2 7/2009 Gilbert et al.
7,575,523 B2 * 8/2009 Yokota ..... A63B 53/0466 473/332
7,588,502 B2 * 9/2009 Nishino ..... A63B 53/0466 473/332
7,699,716 B2 4/2010 Burnett et al.
7,713,141 B2 * 5/2010 Yamamoto ..... A63B 53/047 473/332
7,731,604 B2 6/2010 Wahl
7,815,523 B2 10/2010 Knutson
7,867,105 B2 1/2011 Moon
7,935,000 B2 5/2011 Stites
7,980,960 B2 7/2011 Gilbert
8,062,150 B2 * 11/2011 Gilbert ..... A63B 53/047 473/332
8,147,353 B2 * 4/2012 Gilbert ..... A63B 53/047 473/345
8,157,673 B2 * 4/2012 Gilbert ..... A63B 53/047 473/350
8,235,832 B2 8/2012 Burnett et al.
8,342,985 B2 1/2013 Hirano
8,348,786 B2 1/2013 Nakano
8,491,407 B2 7/2013 Shear et al.
8,512,629 B2 8/2013 Parolini
8,740,721 B2 6/2014 Yamamoto
8,753,219 B2 * 6/2014 Gilbert ..... A63B 53/047 473/291
8,808,109 B2 * 8/2014 Roach ..... A63B 53/047 473/350
8,821,313 B1 9/2014 Dawson
9,011,270 B2 4/2015 Nakano
9,079,081 B2 * 7/2015 Shimazaki ..... A63B 53/047
9,555,296 B2 * 1/2017 Gilbert ..... A63B 53/047
2004/0204263 A1 10/2004 Fagot
2005/0037860 A1 2/2005 Gilbert
2008/0161124 A1 7/2008 Kajita
2008/0318705 A1 12/2008 Clausen et al.
2009/0075751 A1 3/2009 Gilbert
2009/0131199 A1 5/2009 Gilbert
2012/0064997 A1 * 3/2012 Sato ..... A63B 53/047 473/350
2012/0077613 A1 3/2012 Jertson
2013/0344989 A1 12/2013 Hebreo

* cited by examiner

SUPPORTED IRON SET

CROSS-REFERENCE TO RELATED APPLICATIONS

The present application is a continuation-in-part of U.S. patent application Ser. No. 14/688,056, to Zimmerman et al., filed on Apr. 16, 2015, currently pending, which is a continuation-in-part of U.S. patent application Ser. No. 14/626,526, to Ines et al., filed on Feb. 19, 2015, which issued as U.S. Pat. No. 9,427,635 on Aug. 30, 2016, which is a continuation-in-part of U.S. patent application Ser. No. 13/887,701, to Ines et al., filed on May 6, 2013, which issued as U.S. Pat. No. 8,998,742 on Apr. 7, 2015, the disclosures of which are hereby incorporated by reference in their entirety.

TECHNICAL FIELD OF THE INVENTION

The present invention generally relates to iron golf clubs, and more particularly, to sets of iron golf clubs that provide a progressive center of gravity allocation and structural support across the back surface of the faces.

BACKGROUND OF THE INVENTION

In conventional sets of "iron" golf clubs, each golf club includes a shaft with a club head attached to one end and a grip attached to the other end. The club head includes a face for striking a golf ball. The angle between the face and a vertical plane is called "loft." In general, the greater the loft is of the golf club in a set, the greater the launch angle and the less distance the golf ball is hit.

A set of irons generally includes individual irons that are designated as number 3 through number 9, and a pitching wedge. The iron set is generally complimented by a series of wedges, such as a lob wedge, a gap wedge, and/or a sand wedge. Sets can also include a 1 iron and a 2 iron, but these golf clubs are generally sold separately from the set. Each iron has a shaft length that usually decreases through the set as the loft for each golf club head increases, from the long irons to the short irons. The length of the club, along with the club head loft and center of gravity impart various performance characteristics to the ball's launch conditions upon impact. The initial trajectory of the ball generally extends between the impact point and the apex or peak of the trajectory. In general, the ball's trajectory for long irons, like the 3 iron, is a more penetrating, lower trajectory due to the lower launch angle and the increased ball speed off of the club. Short irons, like the 8 iron or pitching wedge, produce a trajectory that is substantially steeper and less penetrating than the trajectory of balls struck by long irons. The highest point of the long iron's ball flight is generally lower than the highest point for the short iron's ball flight. The mid irons, such as the 5 iron, produce an initial trajectory that is between those exhibited by balls hit with the long and short irons.

SUMMARY OF THE INVENTION

The present invention is directed to a set of golf clubs comprising long irons, mid-irons and short irons. The long irons are defined as having aloft angle (LA1) of between 15 and 25 degrees and have a first center of gravity positioned horizontally from the face center by a first distance. The mid-irons are defined as having loft angle (LA2) of between 26 and 36 degrees and have a second center of gravity positioned horizontally from the face center by a second distance. The short irons are defined as having a loft angle (LA3) of between 37 and 47 degrees and have a third center of gravity positioned horizontally from the face center by a third distance. The first distance and the second distance are preferably similar and the third distance is at least about 30% greater than the first and second distances. Preferably, the first and second distances are between about 1 mm and 3 mm and the third distance is between about 3 mm and 4 mm. Moreover, it is preferred that the third distance is greater than about 15% of the vertical distance of the center of gravity position from the ground.

Another aspect of the present invention is having at least 2 long irons, at least 2 mid-irons and at least 2 short irons, wherein each of the long irons has a center of gravity positioned horizontally from the face center that is between about 0 mm and 2.5 mm, each of the mid-irons has a center of gravity positioned horizontally from the face center that is between about 0 mm and 2.5 mm and each of the short irons has a center of gravity positioned horizontally from the face center by about 3 mm to 4 mm. Within this set, it is preferred that the long irons and mid-irons all contain heel and toe weights that are spaced from each other by at least 75% of the blade length and have weight center of gravities that are below the center of gravity for the iron itself. Further it is preferred that at least one of the short irons contains a weight member that has a weight center of gravity that is located above the center of gravity of the iron. Furthermore, the short iron weight member is preferably located on the heel side of the iron, and most preferably, within the hosel of the iron.

Another aspect of the present invention is a set of golf clubs comprising a long iron, a mid-iron and a short iron, wherein the center of gravity location for the short irons are greater than the values defined by the line CG-Xfc=0.02 (LA)+2, where CG-Xfc is the distance of the center of gravity from the face center in the horizontal direction toward the hosel and LA is loft angle.

Still yet another aspect of the present invention is a set of golf clubs comprising at least a long iron, a mid-iron and a short iron, wherein the short iron has a moment of inertia about the shaft axis that falls below the line defined by the linear equation MOI-SA=4.6(LA)+400, wherein MOI-SA is the moment of inertia about the shaft axis and LA is the loft angle. Preferably, the set also includes a very short iron having a moment of inertia about the shaft axis of between 575 kg*mm2 and 600 kg*mm2. It is also preferred that the short iron has a center of gravity height CG-Yg and the CG-Xfc is greater than about 15% of the CG-Yg.

Still yet another aspect of the present invention is a set of golf clubs comprising at least a long iron, a mid-iron and a short iron, wherein blade length throughout the set is approximately constant and the CG-Xfc is progressively increasing from the long iron to the short iron. The set preferably has a constant blade length that is between about 70 and 85 mm, and more preferably, about 75 to 80 mm. In a preferred embodiment, the CG-Xfc increases from less than 2 mm in the long iron to about 3 mm in the short iron. Preferably, the toe height is progressively increasing through the set such that the toe height for the long iron is less than the mid iron, which is less than the short iron. Preferably, the toe height increases through the set from less than about 51 mm to greater than about 55 mm.

The present invention is also directed to a set of golf clubs that have a substantially constant blade length through the set, but scoreline width progressively decreases through the set. Thus, the scoreline width for the long iron is greater than the scoreline width for the mid iron, which is greater than the scoreline width for the short iron. Also, within this set, the scoreline to toe width progressively increases through the set. Thus, the scoreline to toe width for the long iron is less than scoreline to toe width for the mid iron, which is less than the scoreline to toe width for the short iron.

Another aspect of the present invention is to create a set of irons that have hosels that are easy to bend at the bottom section thereof. More particularly, the hosels have a bottom hosel section having a bending force that is less than 75% of the bending force for the upper hosel portion. This can be achieved by including a hollow section at the bottom of the hosel having a larger diameter than the hosel bore or through a local annealing process.

Yet another aspect of the current invention is a method of forming a golf club comprising the steps of: forging a body with a topline, sole portion, toe portion, heel portion, a weight pocket and a face stabilizing bar having a length; machining an aperture into the face stabilizing bar, and attaching a weight member and a back panel to the body to form an undercut, forged iron. The method of forming a golf club can further comprising the step of machining the aperture longitudinally from the heel to the toe a distance of greater than about 25% and less than about 50% of the length of the face stabilizing bar. The method of forming a golf club can also comprising the step of machining an aperture in a bottom surface of the topline.

Still yet a further aspect of the invention is a set of golf clubs comprising at least a long iron, a mid iron and a short iron, wherein the long iron comprises a face stabilizing bar extending from the heel to the toe and a back panel coupled to the face stabilizing bar. Within the set, the center of gravity for the long irons and mid irons are approximately constant and located near the face center of the irons and the center of gravity for the short irons is located at least 30 percent further away from the face center toward the heel than for the long irons and mid irons. Preferably, a plurality of apertures are formed in the face stabilizing bar, and more preferably, the apertures have a combined length that is between 25 percent and 90 percent of the bar length. The apertures can create a plurality of ribs that extend from a face portion of the face stabilizing bar to a back portion of the face stabilizing bar. In the preferred set, the mid irons also have a face stabilizing bar extending from the heel to the toe, a back panel coupled to the mid iron face stabilizing bar and a plurality of apertures formed in the face stabilizing bar. Again, it is preferred that the apertures have a combined length that is between 25 percent and 90 percent of the bar length. In the set, it is preferred that the combined length of the long iron apertures is greater than the combined length of the mid iron apertures.

The present invention also includes a set of golf clubs where the long irons and/or the mid irons have a face stabilizing bar extending from the heel to the toe, a back panel coupled to the face stabilizing bar forming at least a portion of a back wall, and a plurality of back apertures formed in the back wall. In one embodiment of the invention, one of the back apertures is adjacent the heel such that it makes the face stabilizing bar Y-shaped with a portion extending from the sole toward a center of the face stabilizing bar. It is preferred that there are at least three apertures in the back wall with the aperture closest to the heel having an area that is less than the area of the other apertures. The back apertures can comprise between 25 percent and 75 percent of the area between the heel and the toe and the face stabilizing bar and the sole.

Finally, the present invention can be a set of golf clubs comprising long irons and/or mid irons having a face stabilizing bar extending from the heel to the toe having a plurality of face stabilizing bar apertures, a back panel coupled to the face stabilizing bar forming at least a portion of the back wall and a plurality of back wall apertures. Preferably, the back wall apertures in the long irons are larger than the back wall apertures in the mid irons, but both can comprise between about 25 percent and 90 percent of the back area of the back wall.

DETAILED DESCRIPTION OF THE PREFERRED EMBODIMENTS

As illustrated in the accompanying drawings and discussed in detail below, the present invention is directed to an improved set of iron-type golf clubs, wherein the golf clubs have a center of gravity distribution that enables the player to hit more precise shots than conventional golf clubs.

Figure 1:
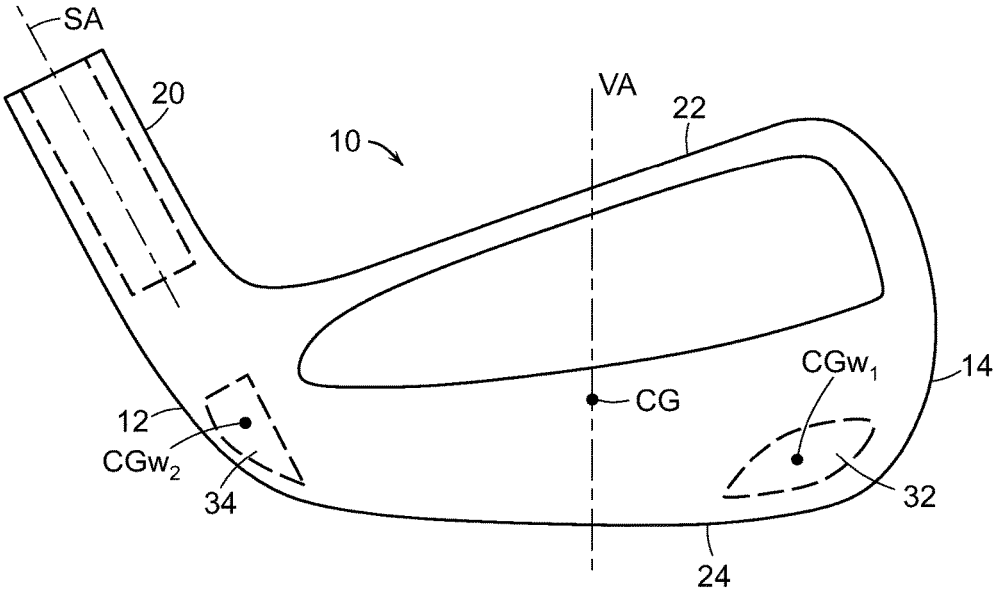
FIG. 1 is a back view of a long iron according to the present invention.

Referring to FIG. 1, a long iron club in the set includes a club head 10 attached to a shaft (not shown) in any manner known in the art, at a hosel 20. The long irons of the present invention have a loft of between about 15 and 25 degrees as is well known in the art. Club head 10 includes, generally, the hosel 20, a striking or hitting face and a back portion that can be cavity backed or muscle backed as is well known in the art. The club head also has a heel 12, a toe 14, a top line 22 and a sole 24. As is well know in the art, the club head 10 and hosel 20 are designed such that the club has a center of gravity CG that is located between the toe 14 and heel 12 and between the top line 22 and the sole 24, which will be discussed in more detail below.

In an embodiment of the present invention, the long iron shown in FIG. 1 also includes a plurality of weight members 32 and 34. The weight members may be embedded into a lower chamber or cavity as set forth in detail in U.S. Pat. No. 8,157,673, which is incorporated by reference in its entirety since the patent is entirely directed to the weight members used in the preferred type of construction, as set forth in FIGS. 1-13 and 25-40, and the frequencies of the preferred irons that can be made thereby, as set forth in FIGS. 14-24. Also, as shown in FIG. 1 herein, the heel weight 34 can be preferably inserted into an aperture machined into the sole 24 adjacent the heel 12. As shown, the weight aperture can be formed to be coextensive with the shaft axis such that the weight 34 is located such that it is intersected by shaft axis SA. Alternatively, the weight aperture can be formed into the heel 12 adjacent the sole 24, but would still be intersected by the shaft axis SA. In the preferred embodiment, the weight members 32 and 34 have a greater density than the material used to form the iron head 10 and preferably a density of greater than 2 times the density of the iron head 10. Most preferably the weight members 32 and 34 have a density of about 17 g/cc.

In the iron head construction, the weight members 32 and 34 are sized and positioned to optimize the irons moment of inertia (MOI) about the vertical axis (VA) and the MOI about the shaft axis (SA). Preferably, the long iron weight members 32 and 34 are each between about 10 g and 40 g. Combined, the weight members 32 and 34 should comprise greater than about 10% of the total body weight. Preferably, the weight members 32 and 34 for the long irons are located such that the weight CGw is located below the club CG in the vertical direction. More preferably, the weight members 32 and 34 each have a CGw1 and CGw2, respectively, that is between about 30% and 75% of the CG-Yg of the club. Still further, the CGw1 and CGw2 are preferably located a distance apart that is greater than 50% of the blade length of the club. More preferably, the CGw1 and CGw2 are located at least about 75% of the blade length away from each other to maximize MOI-Y. The iron head 10, including the weight members 32 and 34, is constructed such that the CG is also allocated in an optimal position relative to the face center and the shaft axis. The details of the CG locations of the irons within the set will be discussed in more detail below.

Figure 2:
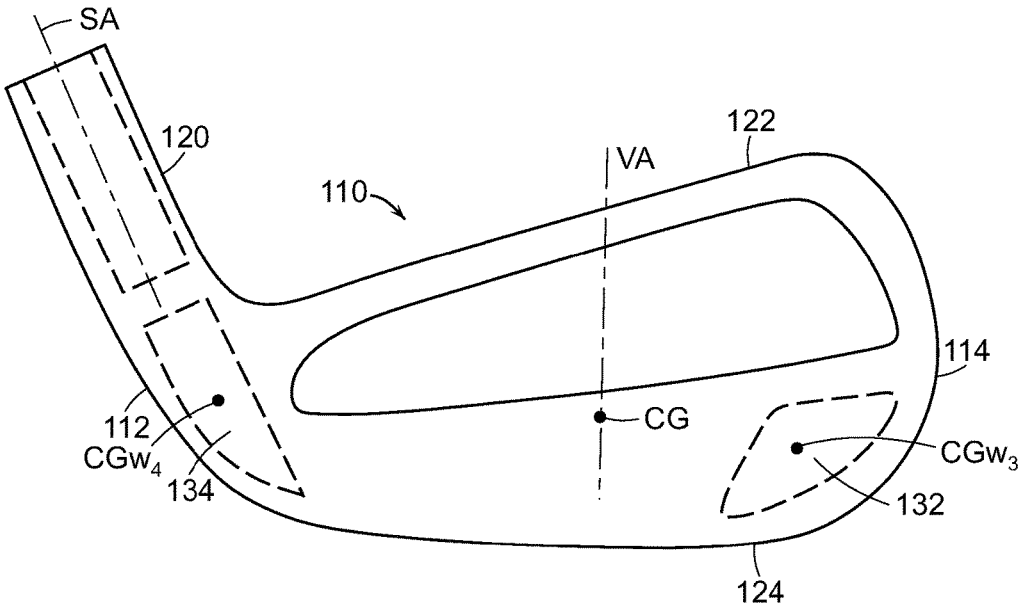
FIG. 2 is a back view of a mid-iron according to the present invention.

As shown in FIG. 2, a mid-iron 110 according to the present invention has a loft of between about 26 and 36 degrees and includes, generally, the hosel 120, a striking or hitting face and a back portion that can be cavity backed or muscle backed as is well known in the art. The club head also has a heel 112, a toe 114, a top line 122 and a sole 124. As is well known in the art, the club head 110 and hosel 120 are designed such that the club has a center of gravity CG that is located between the toe 114 and heel 112 and between the top line 122 and the sole 124, which will be discussed in more detail below.

In an embodiment of the present invention, the mid-iron shown in FIG. 2 also includes a plurality of weight members 132 and 134. The weight members may be embedded into a lower chamber or cavity as set forth in detail in U.S. Pat. No. 8,157,673, which is incorporated by reference in its entirety since the patent is entirely directed to the weight members used in the preferred type of construction, as set forth in FIGS. 1-13 and 25-40, and the frequencies of the preferred irons that can be made thereby, as set forth in FIGS. 14-24. Also, as shown in FIG. 2 herein, the heel weight 134 can be preferably inserted into an aperture machined into the sole 124 adjacent the heel 112. As shown, the weight aperture can be formed to be coextensive with the shaft axis such that the weight 134 is located in a location where it is intersected by shaft axis SA. Alternatively, the weight aperture can be formed into the heel 112 adjacent the sole 124, but would still be intersected by the shaft axis SA. In the preferred embodiment, the weight members 132 and 134 have a greater density than the material used to form the iron head 110 and preferably a density of greater than 2 times the density of the iron head 110. More preferably the weight members 132 and 134 have a density of about 14 to 17 g/cc. Most preferably the weight members 132 and 134 have different densities, wherein the density of the heel weight 134 is less than the density of the toe weight 132. Preferably, the density of the heel weight 134 and the density of the toe weight 132 are about 14 g/cc and 17 g/cc, respectively.

In the iron head construction, the weight members 132 and 134 are sized and positioned to optimize the iron's moment of inertia (MOI) about the vertical axis (VA) and the MOI about the shaft axis (SA). Preferably, the mid-iron weight members 132 and 134 are each between about 20 g and 50 g. Combined, the weight members 132 and 134 should comprise greater than about 15% of the total body weight. Preferably, the weight members 132 and 134 for the mid-irons are located such that at least one of the weight CGw is located below the club CG in the vertical direction. More preferably, the weight member 132 preferably has a CGw3 that is between about 50% and 90% of the CG-Yg of the club and the weight member 134 has a CGw4 that is approximate or greater than CG-Yg. Still further, the CGw3 and CGw4 are preferably located a distance apart that is greater than 50% of the blade length of the club. More preferably, the CGw3 and CGw4 are located at least about 50% and less than 80% of the blade length away from each other to optimize MOI-Y. The iron head 110, including the weight members 132 and 134, is constructed such that the CG is allocated in an optimal position relative to the face center and the shaft axis. The details of the CG locations of the irons within the set will be discussed in more detail below.

Figure 3:
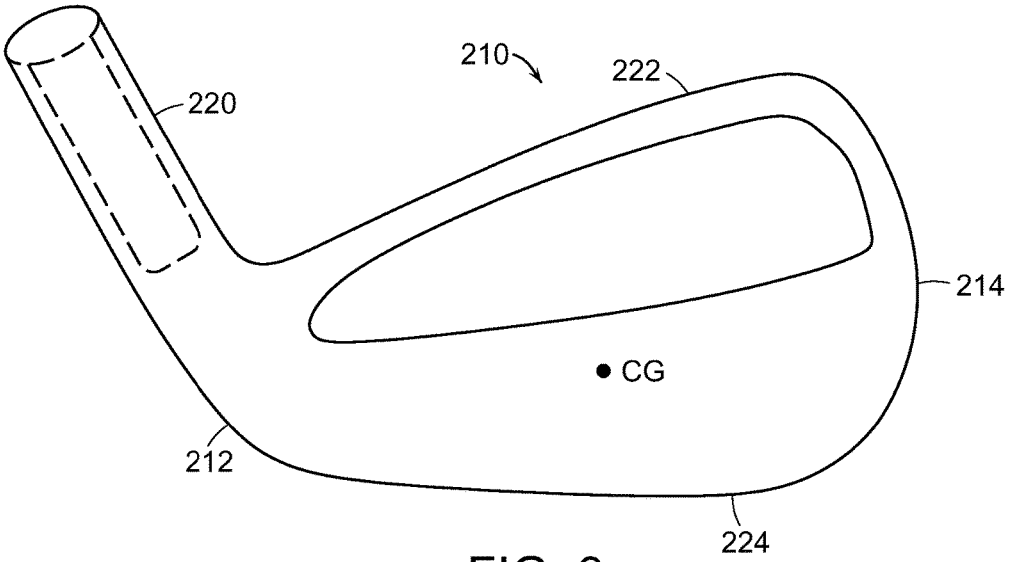
FIG. 3 is a back view of a short iron according to the present invention.
Figure 4:
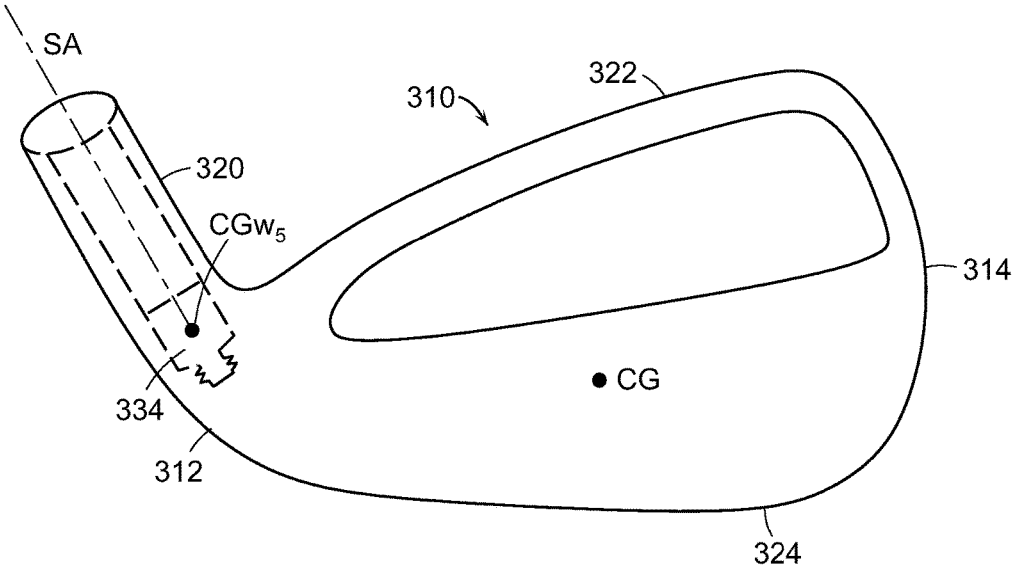
FIG. 4 is a back view of another embodiment of a short iron according to the present invention.

FIGS. 3 and 4 depict alternate embodiments of short irons according to the present invention 210 and 310, respectively. The iron short iron according to the present invention has a loft of between 37 and 47 degrees. The iron 210 includes a hosel 220, toe 214, heel 212, topline 222 and sole 224. The iron 210 is constructed such that it has a center of gravity CG as discussed in more detail below. The iron 310 includes a hosel 320, toe 314, heel 312, topline 322 and sole 324. The iron 310 may have a heel weight member 334 located in the bottom portion of the hosel 320 such that it is intersected by the shaft axis SA. Preferably, the heel weight 334 has a specific gravity greater than the iron material, and more preferably, greater than about 2 times the specific gravity of the iron material. Preferably, the density of the heel weight is about 17 g/cc. Still further, the weight member 334 has a center of gravity CGw5 that is located approximate or above the club CG in the vertical direction and is located a distance from the club CG that is greater than about 40% of the club blade length. Also, it is preferred that there is only a single high density weight member or no high density weight members such that the short irons 210 and 310 are constructed in a manner that they have a center of gravity CG as discussed in more detail below.

Figure 5:
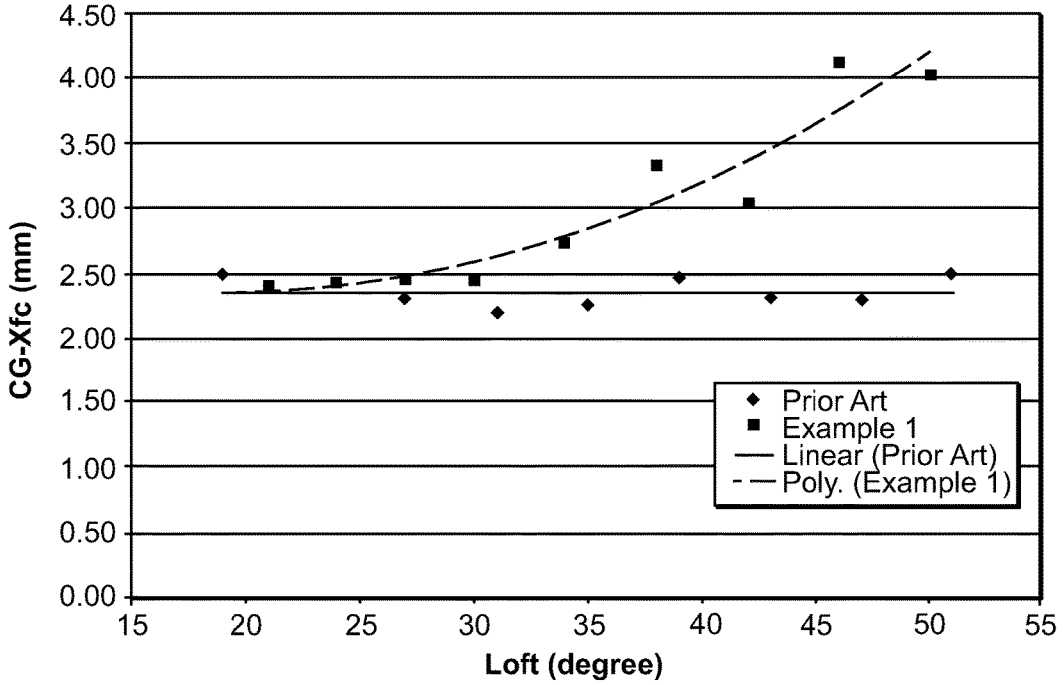
FIG. 5 is a graph depicting the center of gravity of a set of irons according to the present invention.
Figure 6:
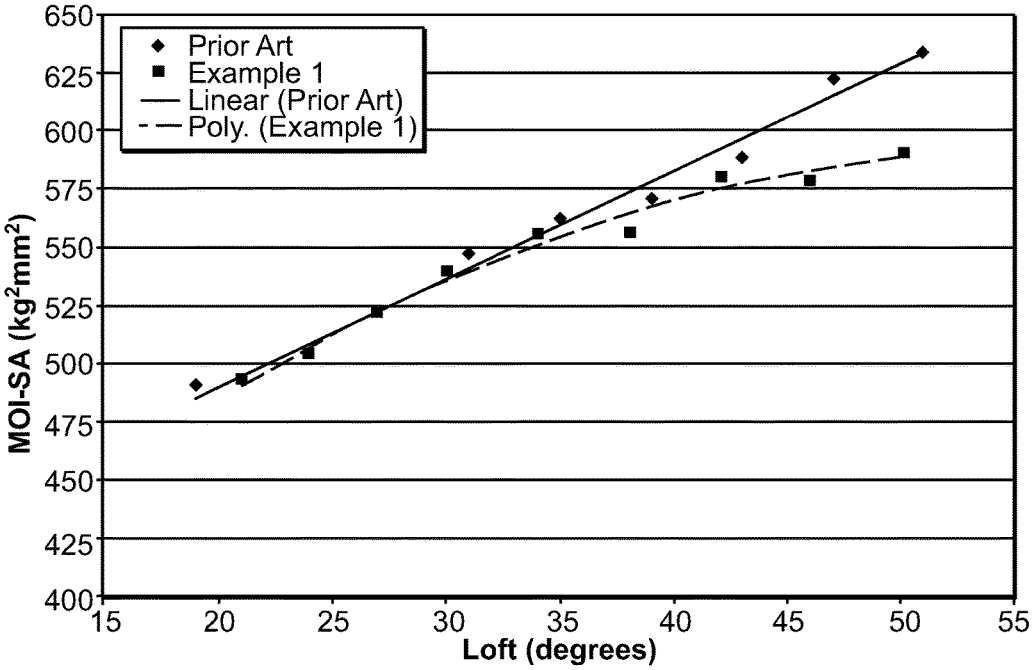
FIG. 6 is a graph depicting the moment of inertia about the shaft axis for a set of irons according to the present invention.

In accordance with an aspect of the present invention, the inventive iron golf clubs are designed to have progressive centers of gravity as set forth in FIG. 5, for example and which is merely illustrative of a preferred embodiment of the present invention set of golf clubs, and is not to be construed as limiting the invention, the scope of which is defined by the appended claims. Each inventive iron golf club is designed to hit golf balls a prescribed distance in the air, and to stop on the green or fairway in a predictable manner.

Tables I and II provides exemplary, non-limiting dimensions for the various measurements of golf clubs according to the prior art and to the Example of the invention, respectively. It is fully intended that all of the dimensions set forth below can be adjusted such that the overall objective of the individual irons in met. As a non-limiting example, a 3 iron according to the invention can be made with a loft of 20-22 degrees to adjust the angle of descent and remain within the scope of the present invention.

TABLE I

| | Club Number | | | | | | | | | |
|---|---|---|---|---|---|---|---|---|---|---|
| | 2 | 3 | 4 | 5 | 6 | 7 | 8 | 9 | P | W |
| loft | 19 | 21 | 24 | 27 | 31 | 35 | 39 | 43 | 47 | 51 |
| CG-Yg | 19.4 | 18.9 | 18.6 | 18.5 | 18.3 | 18.2 | 18.3 | 18.1 | 18.0 | 17.8 |
| CG-Bsa | 36.0 | 35.9 | 35.7 | 35.7 | 35.6 | 35.7 | 35.4 | 35.4 | 35.4 | 35.0 |
| CG-Zth | −7.8 | −7.6 | −8.0 | −8.2 | −8.9 | −9.8 | −9.9 | −10.6 | −12.0 | −12.9 |
| CG-Xfc | 2.49 | 2.40 | 2.38 | 2.30 | 2.20 | 2.25 | 2.46 | 2.31 | 2.30 | 2.5 |
| MOI-X | 46 | 47 | 49 | 50 | 51 | 54 | 66 | 68 | 71 | 73 |
| MOI-Y | 231 | 233 | 238 | 242 | 248 | 262 | 270 | 276 | 293 | 296 |
| MOI-Z | 262 | 265 | 268 | 271 | 274 | 284 | 298 | 300 | 310 | 306 |
| MOI-SA | 491 | 493 | 505 | 522 | 547 | 562 | 570 | 588 | 622 | 634 |

TABLE II

| | Club Number | | | | | | | | |
|---|---|---|---|---|---|---|---|---|---|
| | 3 | 4 | 5 | 6 | 7 | 8 | 9 | P | W |
| loft | 21 | 24 | 27 | 30 | 34 | 38 | 42 | 46 | 50 |
| CG-Yg | 18.7 | 18.5 | 18.6 | 18.6 | 18.6 | 19.4 | 19.2 | 19.1 | 18.7 |
| CG-Bsa | 35.7 | 35.6 | 35.6 | 35.6 | 35.3 | 35.1 | 35.3 | 34.2 | 34.1 |
| CG-Zth | −7.5 | −7.8 | −8.2 | −8.5 | −9.1 | −9.9 | −10.8 | −11.3 | −12.1 |
| CG-Xfc | 2.4 | 2.5 | 2.4 | 2.4 | 2.7 | 3.3 | 3.0 | 4.1 | 4.0 |
| MOI-X | 46.2 | 47.8 | 49.3 | 49.8 | 51.9 | 62.4 | 66.0 | 69.3 | 73.0 |
| MOI-Y | 238.3 | 239.7 | 243.2 | 252.6 | 263.5 | 253.3 | 258.4 | 273.5 | 279.5 |
| MOI-Z | 268.1 | 269.2 | 271.7 | 278.6 | 286.2 | 279.7 | 280.7 | 290.0 | 290.3 |
| MOI-SA | 492.7 | 504.3 | 521.8 | 539.6 | 556.0 | 555.7 | 580.1 | 578.4 | 590.3 |

Referring to the data above and the graph in FIG. 5, it is clear that in the irons according to the present invention the center of gravity is located a distance away from the face center CG-Xfc in a manner that is significantly different than with the prior art golf clubs. The face center is defined as the location that is in the middle of the scorelines and half way between the leading edge and the topline of the club. In the prior art golf clubs, the CG-Xfc remains substantially constant through the set. In general, the CG-Xfc in the prior art golf clubs is located between about 2 to 2.5 mm away from the face center towards the heel of the golf club (about 0.1 inch). In the irons according to the present invention, the CG-Xfc for the short irons range from about 40% to 60% further away from the face center than the long irons. More particularly, in the inventive example above and as shown in FIG. 5, the CG-Xfc remains approximately constant at about 2.4 mm from the face center through the long irons and the mid-irons. All of the long irons (3 and 4) have a CG-Xfc that is within 15% of each other. All of the mid-irons (5, 6, and 7) have a CG-Xfc that is within 15% of each other. Further, all of the long irons (3 and 4) have a CG-Xfc that is within 15% of all of the mid-irons (5, 6, and 7). However, the short irons (8-W) have CGs that are substantially closer to the hosel or, in other words, substantially further away from the face center in the x (horizontal) direction. In fact, all of the example short irons have a CG-Xfc that is at least 40% greater than the CG-Xfc for the long irons. Preferably, all of the short irons according to the invention have a CG-Xfc that is at least 30% greater than the long irons and the mid-irons. More preferably, all of the short irons of the present invention have a CG-Xfc that is between 35% and 70% greater than the long irons and the mid-irons.

Moreover, as shown in FIG. 5, the CG-Xfc of the irons according to the present invention varies through the set according to an exponential curve when plotted versus loft angle. As shown, in the irons according to the prior art, the CG-Xfc remains substantially constant, and thus, the CG-Xfc is substantially linear with no slope. Conversely, in the irons according to the present invention, the CG-Xfc remains substantially constant for long irons and mid-irons and then significantly increases for the short irons. Thus, the best fit equation to describe the relationship of the CG-Xfc according to loft is a second order polynomial. Preferably, the irons according to the present invention have a CG-Xfc for the short irons that are greater than the values defined by the line CG-Xfc=0.02(LA)+2.

Still further, the distance of the center of gravity to the ground CG-Yg remains similar for the golf clubs in the prior art and in the set according to the present invention. However, for the example set according to the present invention, the CG-Xfc is greater than 15% of CG-Yg for the short irons. For this example, the CG-Xfc ranges from about 15% to 20% of the CG-Yg for the short irons. Thus, the relationship of CG-Xfc to CG-Yg is substantially different than in the prior art golf clubs.

Referring to Table I and Table II above, the relationship of the moment of inertia about the shaft axis (MOI-SA) is substantially different between the prior art and the inventive golf clubs. In the very short irons, irons having a loft of between 45 and 52 degrees, the MOI-SA in the prior art is greater than 600 kg*mm2 and closer to about 625 kg*mm2. However, in the inventive irons set forth herein, the MOI-SA for the very short irons is less than 600 kg*mm2 and more preferably between 575 kg*mm2 and 600 kg*mm2. As set forth in FIG. 6, the MOI-SA for the prior art is best represented by a linear equation which is approximately MOI-SA=4.6LA+400. On the other hand, the MOI-Sa for the irons according to the present invention are best represented by a second degree polynomial equation. As shown, the MOI-SA for the short irons, including the very short irons, all fall below the linear equation of the prior art.

As set forth in Table II, the center of gravity distance from the ground CG-Yg within the set should be set to assist with the creation of the preferred flight paths. Options can include, for example, lowering the center of gravity of the long irons through the use of inserts formed from a material having a specific gravity of greater than 10 g/cc such as tungsten or a tungsten alloy. Additionally, the hosel of the long irons can be comprised of a material having a specific gravity of less than 7 g/cc such as titanium, aluminum or alloys thereof. Conversely, high specific gravity materials may be employed within the topline portion of the short irons to raise the center of gravity.

Figure 7:
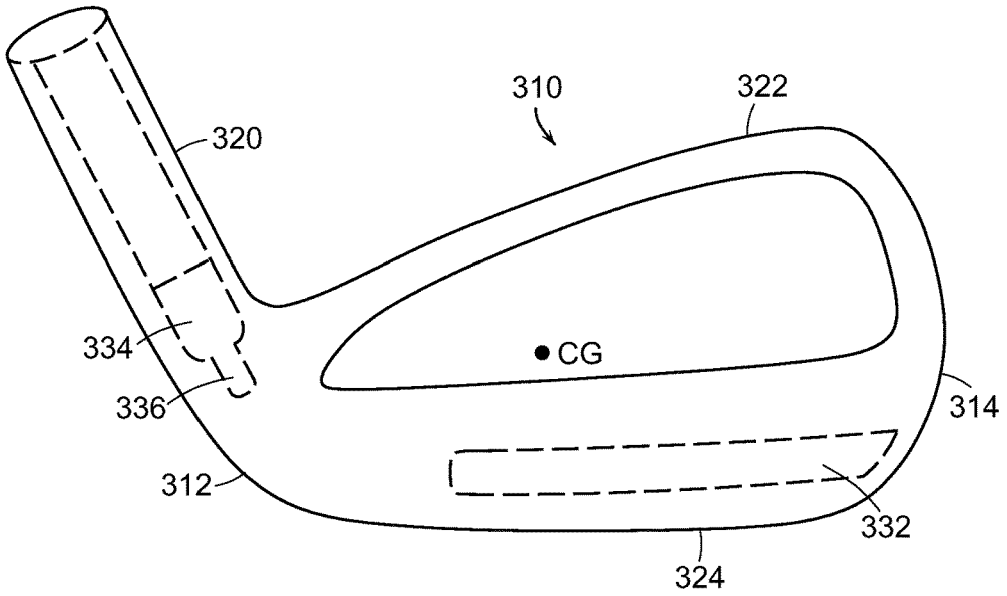
FIG. 7 is a back view of another embodiment of a short iron according to the present invention.

Referring to FIG. 7, the short irons 310 according to the present invention, may employ a heel weight member 334 located in the bottom portion of the hosel 320 that is threaded in using a threaded section 336, such that it is intersected by the shaft axis SA. Preferably, the heel weight 334 has a specific gravity greater than the iron material, and more preferably, greater than about 2 times the specific gravity of the iron material. Preferably, the density of the heel weight is about 17 g/cc. The iron 310 may also include a low weight insert 332 or an aperture that is formed from the toe section 314 so that the CG-Xfc is formed closer to the shaft axis. Preferably, the low weight insert 332 would have a specific gravity of less than the specific gravity of the iron material, and more preferably, about half of the specific gravity of the iron material or less. The low weight insert may be formed from a low specific gravity metal such as aluminum or an elastomeric material.

Figure 8:
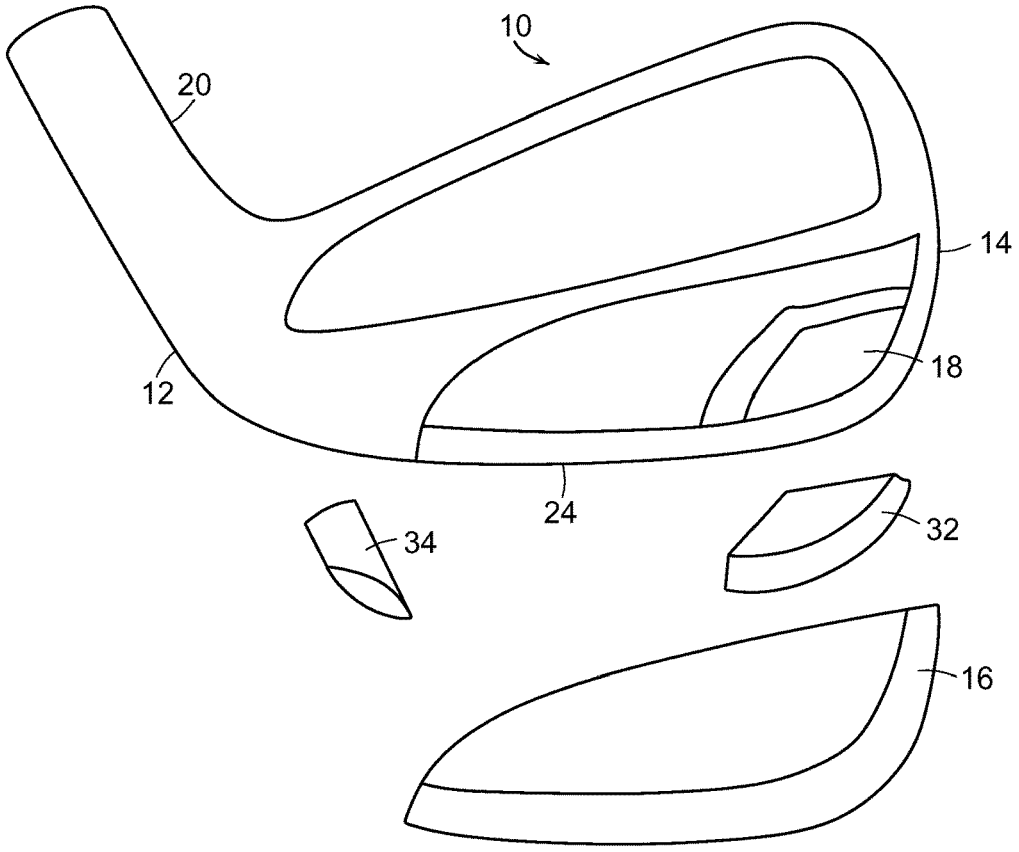
FIG. 8 is an exploded view of a long iron construction according to the present invention.

FIG. 8 is an exploded view of the components forming the long iron 10 as shown in FIG. 1. The long iron can be formed by forging the body 10, including a weight pocket 18 adjacent the toe section 14. After the body 10 is formed, an aperture can be formed in the sole 24, near the heel 12, such that a weight insert 32 can be securely fastened therein by a press fit, welding or adhesive. After the toe weight 32 is attached in the weight pocket 18, a back panel 16 can be secured to the body 10. Preferably, the back panel and the body are formed from the same materials such that they can be welded together.

Figure 9:
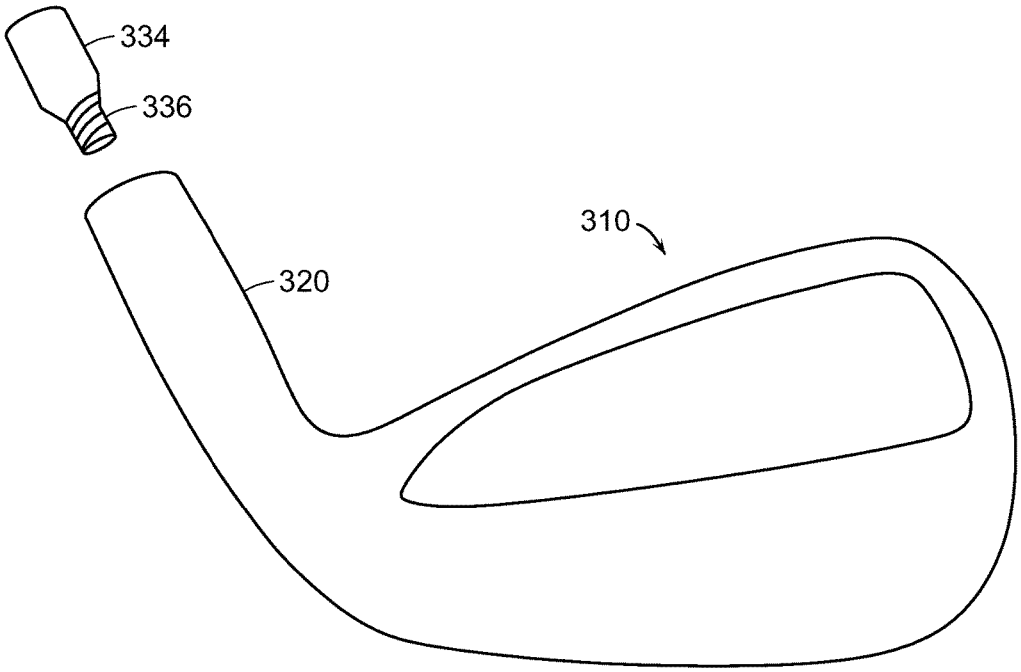
FIG. 9 is an exploded view on a short iron according to the present invention.
Figure 10:
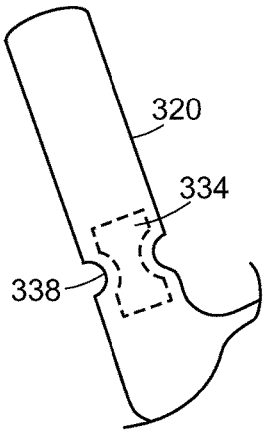
FIG. 10 is a close up view of a hosel of a short iron according to another embodiment of the present invention.

Referring to FIGS. 9 and 10, the short irons according to the present invention may be formed by forging the body 310. The body may include a back panel welded to the body as set forth in FIG. 8, but may be solid. The weight member 334 is preferably formed with a threaded portion 336 and is threaded into the bottom of the hosel 320. Alternatively, as shown in FIG. 10, a weight member 334 may be inserted into the hosel 320 and then a compressive force can be applied to the perimeter of the hosel 320 to form a crimped section 338 that retains the weight member securely in the hosel 320. The diameter of the crimped section 338 of the hosel 320 should be greater than 80% of the hosel diameter and more preferably between 90% and 95% of the hosel diameter.

Figure 11:
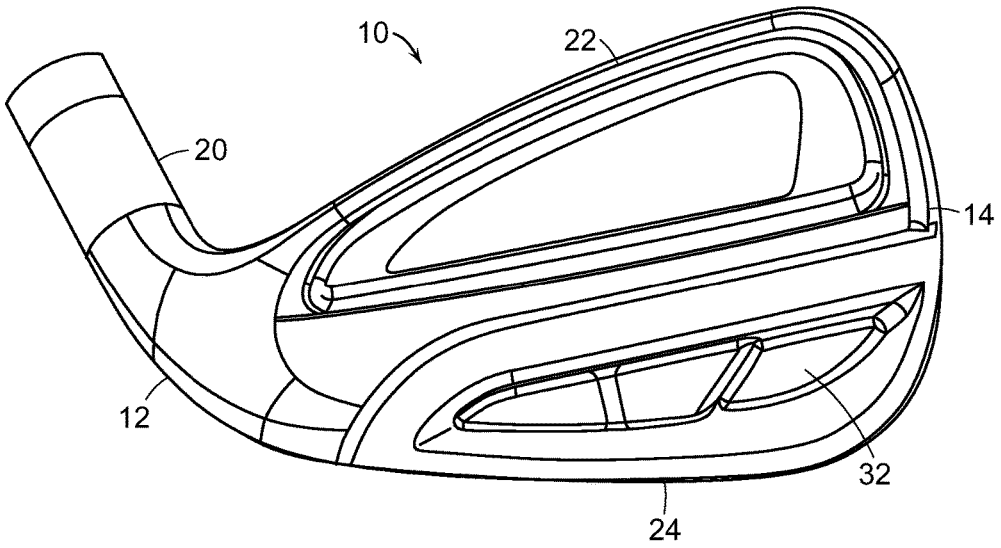
FIG. 11 is a portion of a long iron according to another embodiment of the present invention.
Figure 12:
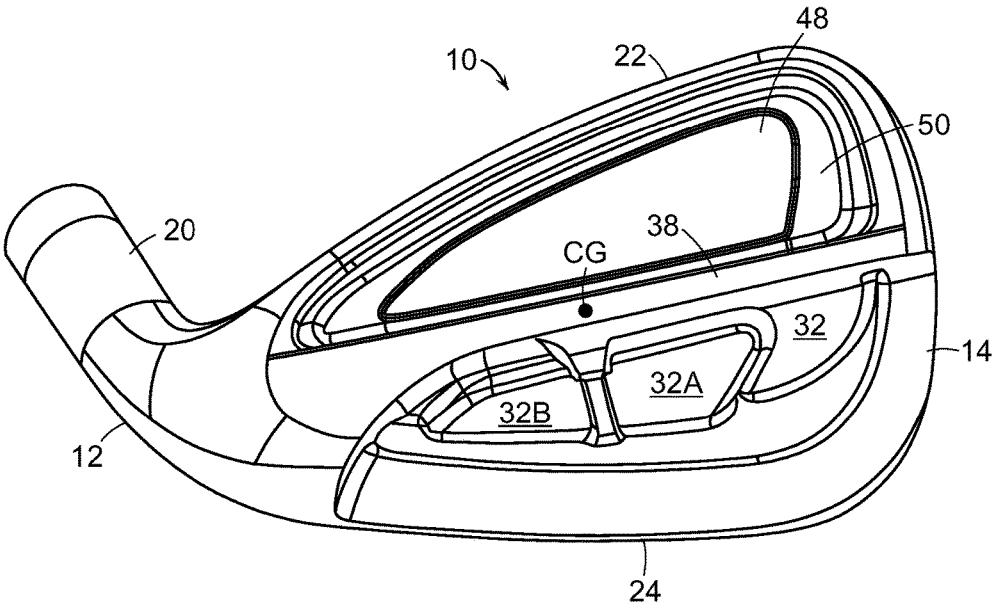
FIG. 12 is a portion of a mid-iron according to another embodiment of the present invention.

Referring to FIG. 11, in an alternate embodiment of the present invention, the club head 10 can be formed by forging the body with weight pads 32. Thus, in this embodiment, the weight members 32 are integrally formed with and attached to the back portion of the face. The back panel 16 as set forth above can then be welded over the weight member 32. This construction method may be preferred for the long irons, mid irons or short irons of the present invention. However, referring to FIGS. 11 and 12, if the long irons and mid irons are formed according to this method, it is preferred that the weigh member 32 for the mid irons is located adjacent the face stabilizing bar 38 for the mid-irons and adjacent the sole 24 for the long irons. In this manner, the CG-Yg is designed to be relatively lower in the long irons than in the mid-irons. Also, as shown in FIG. 12, the weight member 32 can be formed into multiple portions 32A and 32B that are preferably located on opposite sides of the CG to provide a relatively high MOI-Y. The CG location through the set can also be adjusted by providing for a variable face thickness above the stabilizing bar 38. The upper back wall 48 can be designed a depth from the front face such that the upper face thickness through the set increases with loft. For example, the long irons can be designed with an upper face thickness of about 2.1 mm, the mid irons can have an upper face thickness of about 2.4 mm to 2.7 mm and the short irons can have an upper face thickness of about 2.7 mm to 3.5 mm. The perimeter of the upper face 50 can be about 0.05 mm to 0.25 mm thicker that the center portion 48. Preferably, the upper face thickness is as thick as or thicker than the next club in the set with a lower loft and the upper face thickness of a short iron is at least 50% greater than the upper face thickness of a long iron.

Figure 13:
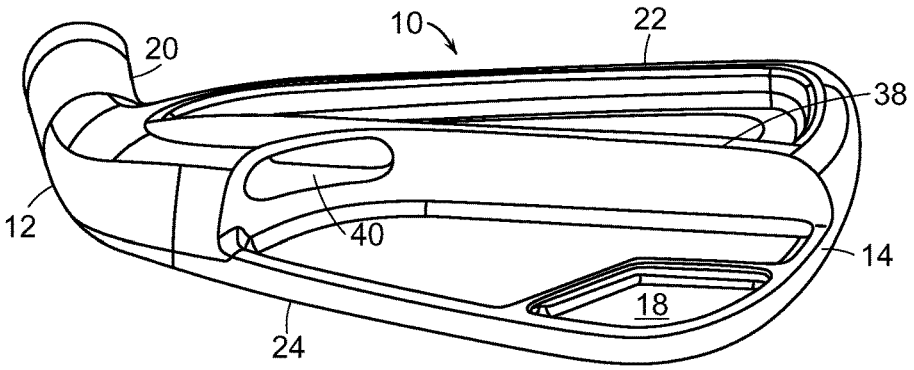
FIG. 13 is a portion of a long iron according to another embodiment of the present invention.
Figure 14:
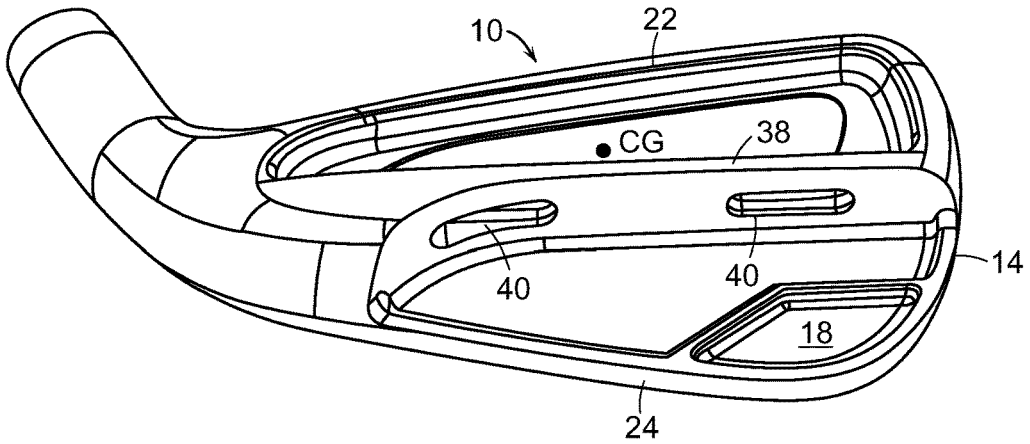
FIG. 14 is a portion of a long iron according to another embodiment of the present invention.
Figure 15:
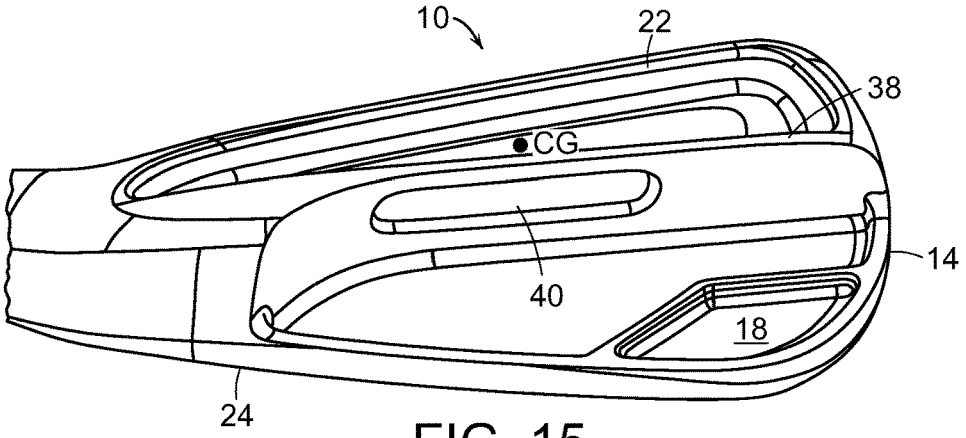
FIG. 15 is a portion of a long iron according to another embodiment of the present invention.

Yet another way to design an iron having the CG according to the present invention is to from a body 10 as shown in FIG. 13. The head body 10 can be formed by forging the body with a topline 22, sole portion 24, toe portion 14, heel portion 12, a weigh pocket 18 and a face stabilizing bar 38. If the member is forged, an aperture 40 can be formed in the face stabilizing bar 38 prior to the attachment of the back panel 16. Preferably, the aperture is machined into at least a portion of the face stabilizing bar 38. If the body is cast, the aperture 40 can be formed in the casting and machining can be avoided. Referring to FIG. 14, more than one aperture 40 may be desired. Thus, the club 10 may include one or more apertures formed into the face stabilizing bar 38. Preferably, the apertures are located on the sole side of the face stabilizing bar 38 and are covered by a back panel 16. In yet another embodiment of the present invention as set forth in FIG. 15, the aperture 40 can extend longitudinally from the heel 12 to the toe 14 a distance of greater than about 25% and less than about 50% of the length of the face stabilizing bar 38. Preferably, the aperture 40 extends through the face stabilizing bar 38 toward the topline by about 50% to about 90%. By forming the aperture 40 such that is extends on both sides of the CG as shown in FIG. 15, the MOI-Y can be optimized. Although not shown, similar apertures can be formed in the bottom surface of the topline 22.

Figure 16:
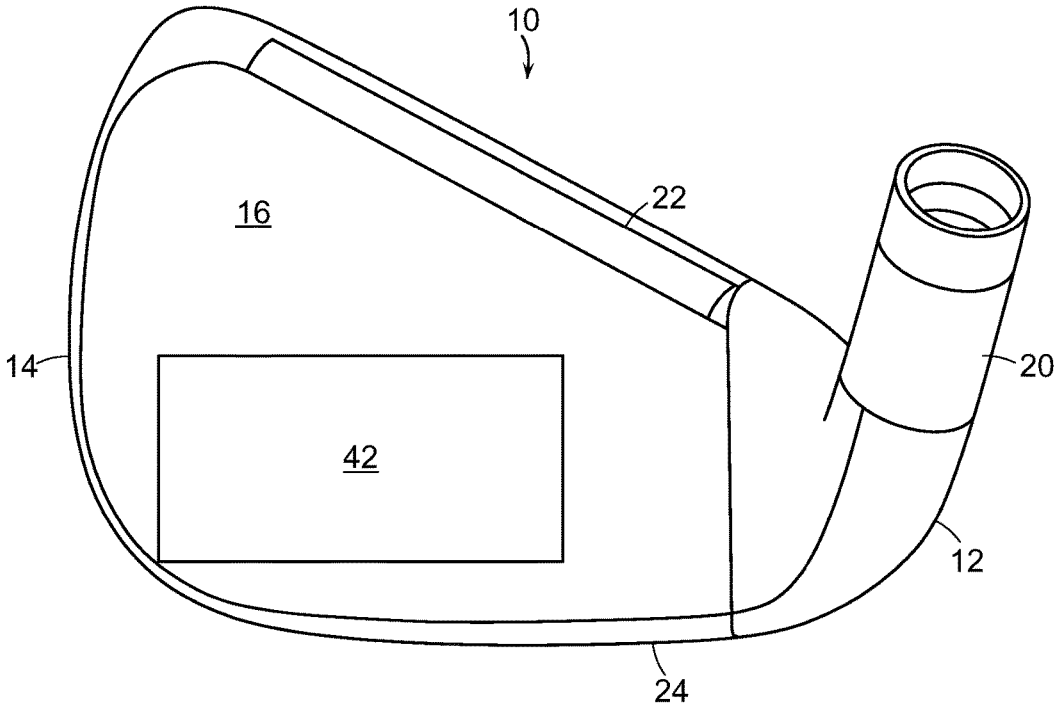
FIG. 16 is a perspective view of a long iron according to another embodiment of the present invention.
Figure 17:
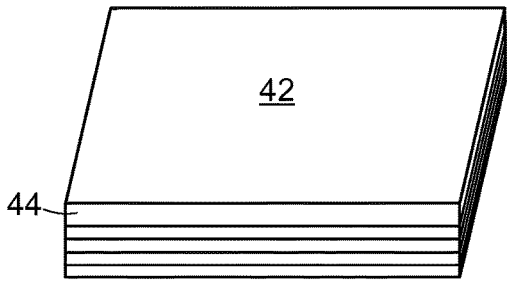
FIG. 17 is an insert for a long iron according the embodiment set forth in FIG. 16.

Another way to accomplish the progression of the center of gravity CG-Yg through the set according to the present invention is to employ a low weight face insert as shown in FIGS. 16 and 17. Referring to FIG. 16, the face 16 can be made of different materials throughout the set. For example, the long irons could employ a titanium alloy insert such as Ti 6-4, which has a specific gravity of 4.4 g/cc and the mid-irons and short irons could employ steel faces having a specific gravity of about 7.9 g/cc. By using higher strength steel in the mid-irons, such as 17-4 stainless steel, the faces can be designed thin to reduce weight and by using a softer steel, such as 431 stainless steel, in the short irons, the feel of the short irons can be improved. Also, as shown in FIG. 17, a composite insert 42 comprised of multiple layers of prepreg layups 44 may be used. Preferably, a face insert 42 can be located in a thin cavity behind the face material 16 that can be the same material as the body 10. The insert 42 should extend longitudinally at least about 50% between the heel 12 and the toe 14. The height of the insert can be varied, but is preferably between at least 10% and 90% of the height of the iron between the sole 24 and the topline 22.

TABLE III

| | Club Number | | | | | | | | |
|---|---|---|---|---|---|---|---|---|---|
| | 2 | 3 | 4 | 5 | 6 | 7 | 8 | 9 | P |
| loft | 18 | 21 | 24 | 27 | 31 | 35 | 39 | 43 | 47 |
| Blade Length (mm) | 76.2 | 76.2 | 76.2 | 76.2 | 76.2 | 76.2 | 76.2 | 76.2 | 76.2 |
| Toe Height (mm) | 50.3 | 50.6 | 51.0 | 51.4 | 51.9 | 52.4 | 53.5 | 54.6 | 55.9 |
| Scoreline Width (mm) | 52.4 | 52.2 | 52.1 | 52.0 | 51.8 | 51.6 | 51.3 | 50.9 | 50.4 |
| Scoreline to Toe (mm) | 17.3 | 17.4 | 17.5 | 17.7 | 17.9 | 18.0 | 18.4 | 18.8 | 19.2 |
| CG-Xfc (mm) | 1.9 | 1.95 | 1.9 | 2.2 | 2.5 | 2.5 | 2.5 | 3.0 | 3.0 |

Figure 18:
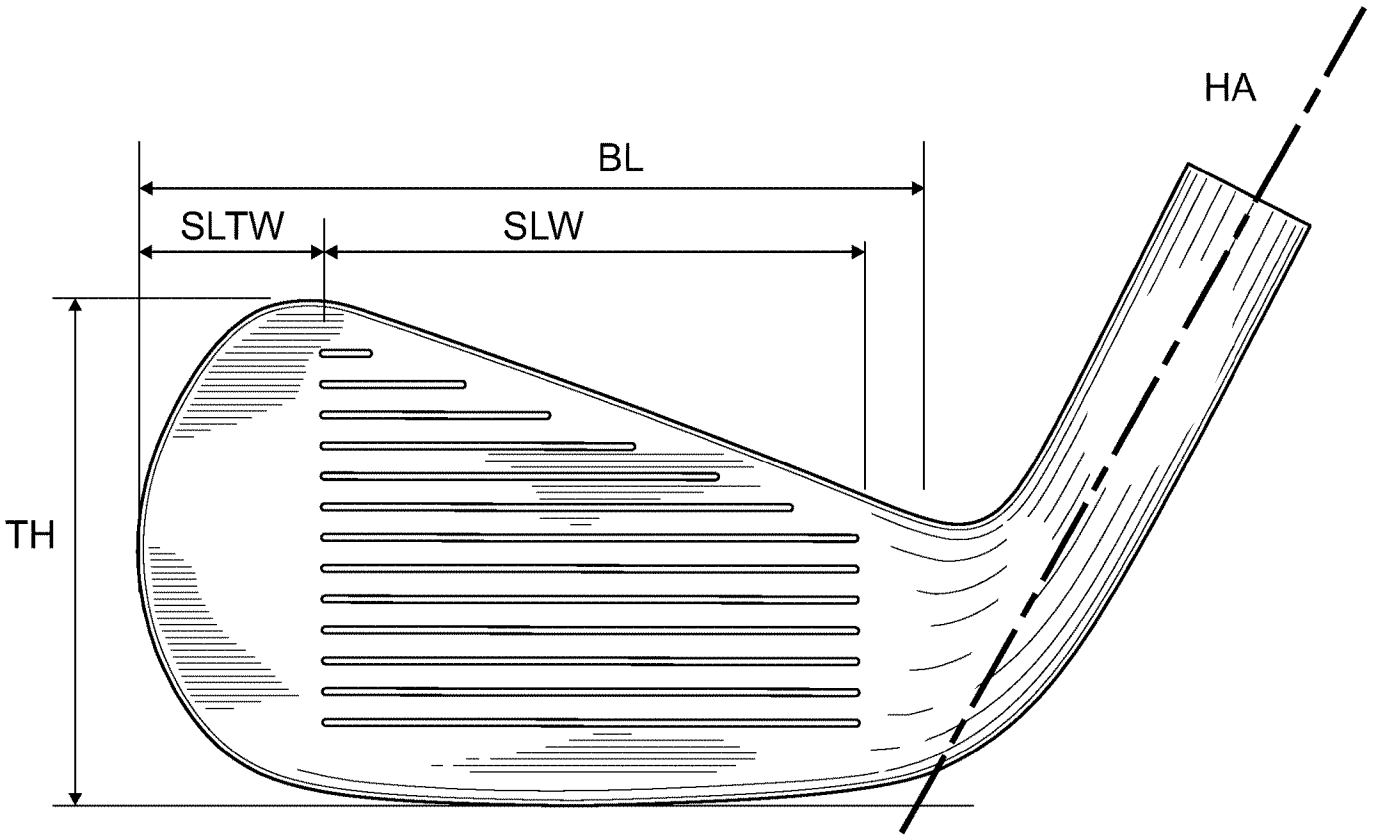
FIG. 18 is a front view of a long iron according to another embodiment of the present invention.

As shown in FIG. 18 and set forth in Table III above, another embodiment of the present invention includes a set of irons that have a substantially constant Blade Length (BL) throughout the set. The BL is defined at the length from the hosel axis (HA) intersection with the ground plane to the end of the toe. However in this set, the Toe Height (TH) progressively increases through the set. Thus, the TH of the mid iron is greater than the TH of the long iron and the TH of the short iron is greater than the TH of the mid iron and the long iron. The TH is defined as the maximum length from the leading edge to the top of the toe in the plane parallel to the face plane and perpendicular to the scorelines. Preferably, the TH increases by about at least 0.3 mm per club, and most preferably at least 0.4 mm per club. Also, the TH preferably increases at least 1 mm per club (or about 4 degrees of loft) for the short irons and only 0.3-0.6 mm per club for the long and mid irons.

Furthermore, even though the BL remains substantially constant through the set, the scoreline width (SLW) progressively decreases through the set and the scoreline to toe width (SLTW) progressively increases through the set. More particularly, the SLW decreases by at least about 0.1 mm per club (or per 4 degrees of loft). Thus, the SLW for the long iron is greater than the SLW for the mid iron and the SLW for the mid iron is greater than the SLW for the short iron. Moreover, because the SLTW progressively increases through the set, the non-grooved toe area increases throughout the set.

Still further, in this preferred embodiment of the present invention, the distance of the center of gravity from the face center progressively increases through the set. Thus, CG-Xfc progressively increases from less than 2 mm from the face center in the long irons to about 3 mm from the face center towards the hosel in the short irons.

Figure 19:
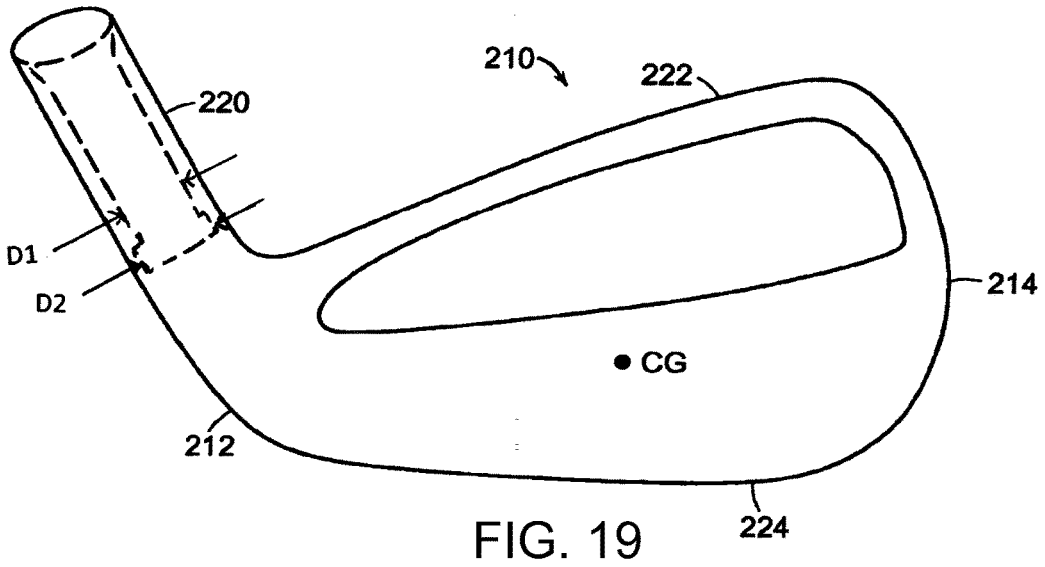
FIG. 19 is a back view of an iron according to another embodiment of the present invention.
Figure 20:
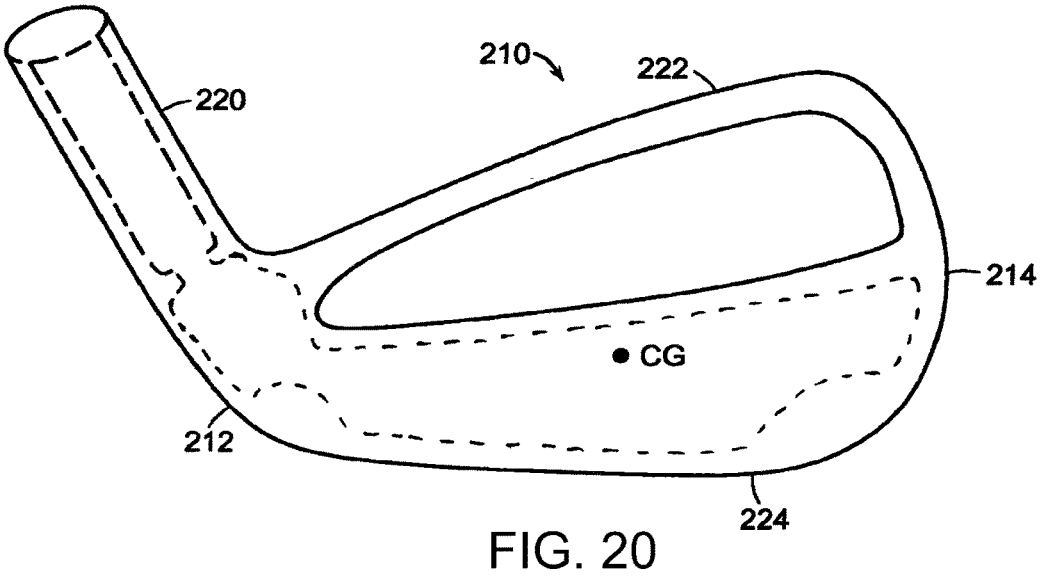
FIG. 20 is a back view of an iron according to another embodiment of the present invention.

Another aspect of the present invention is to have a bendable hosel by having a localized bend location at the bottom portion of the hosel. Referring to FIGS. 19 and 20, an iron 210 according to the present invention includes a hosel 220, toe 214, heel 212, topline 222 and sole 224. As shown in FIG. 19, the hosel 220 includes a bore having a diameter D1 that is substantially the same size as the diameter of the shaft tip to be inserted into the hosel. This section is the upper hosel portion. Preferably, the iron also includes a hollow section in the bottom section of the hosel that has a diameter D2 that is greater than D1. Preferably, D2 is between 5% and 10% greater than D1 such that the hosel is bendable in the bottom section because the wall thickness is less around the bottom section. More particularly, the bending force required to bend the hosel at the bottom section is less than 75% of the bending force required to bend the hosel at upper hosel section. More preferably, the iron 210 has a hosel having a length of about 30 to 50 mm, and the bottom section of the hosel has a length of about 3 to 10 mm. The bottom section with the larger diameter D2 is preferably only about 5% to 20% of the hosel length and the upper hosel section is 80% to 95% of the hosel length.

In another embodiment of the present invention, the iron can be hollow or at least partially hollow as shown in FIG. 20. In this embodiment, the hosel bore can be open and in fluid communication to the hollow section of the iron. Like in FIG. 19, preferably, the hollow section at the bottom of the hosel has a greater diameter than the hosel bore such that the iron hosel is bendable in this section.

In yet another embodiment of the present invention, the bottom section of the hosel, i.e. the bottom 5% to 20% of the hosel, is subject to a localized annealing process. The annealing process alters the physical and sometimes chemical properties of a material to increase the ductility of the bottom section of the hosel to make it more workable. Preferably, the annealed section has a bending force that is less than 75% of the bending force of the upper hosel section. The annealing process involves heating the localized area of the hosel to above its glass transition temperature, maintaining a suitable temperature, and then cooling. The hosel annealing process preferably uses an induction heating coil that goes around the bottom section of the hosel. The temperature of the bottom section is increased to about 500° C. to 1000° C., and more preferably to about 800° C. to 850° C. Preferably, once the bottom section of the hosel is heated, it is held at the elevated temperature for about 5 to 20 seconds, and more preferably, for about 10 seconds. Then the iron is cooled.

Figure 21:
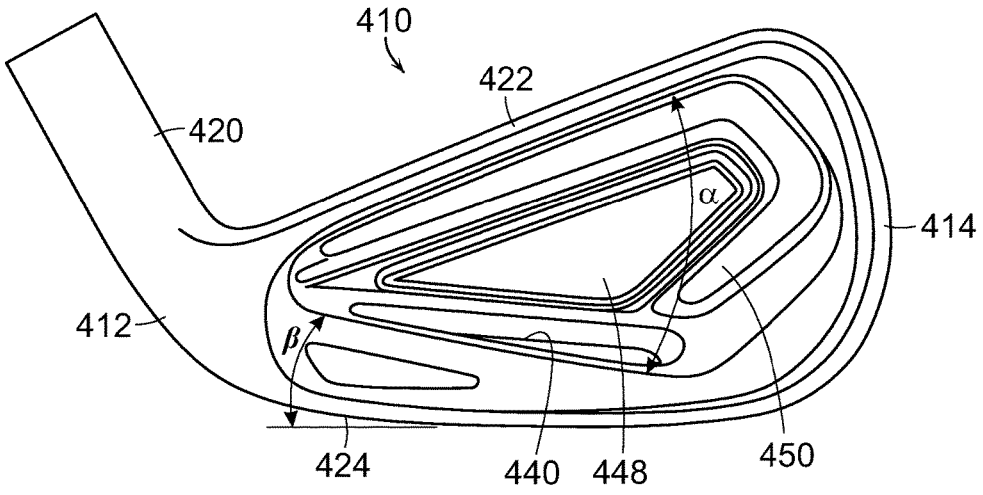
FIG. 21 is a back view of an iron according to another embodiment of the present invention.
Figure 23:
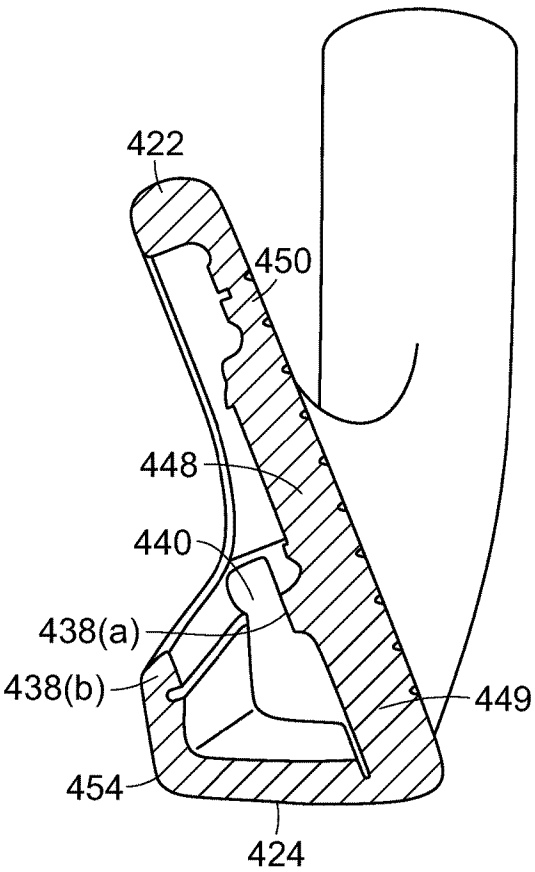
FIG. 23 is a cross-sectional view of an iron according to FIG. 21.
Figure 22:
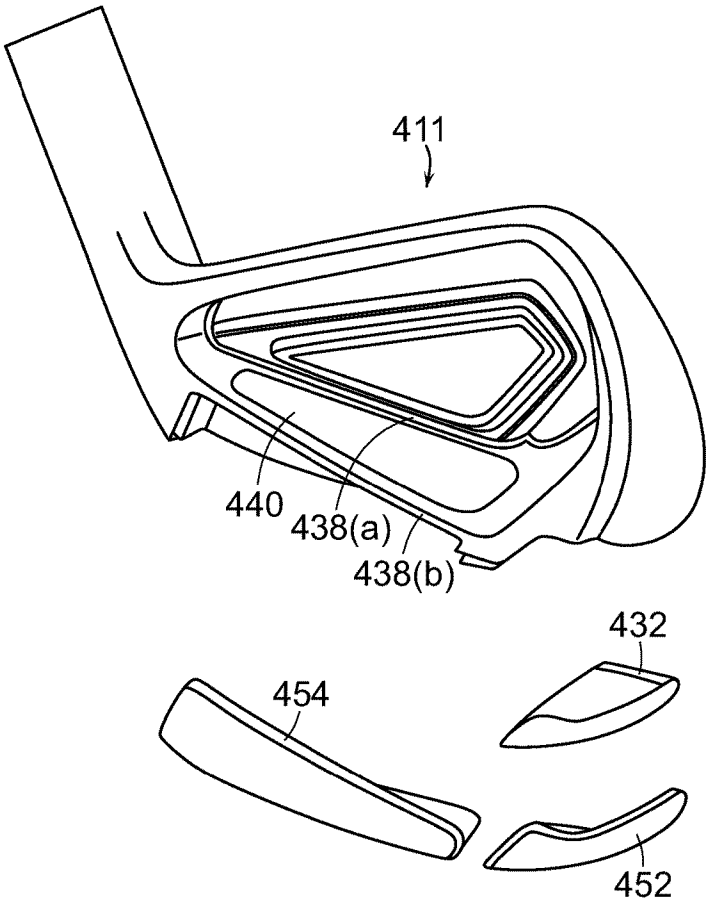
FIG. 22 is an exploded view of an iron according to FIG. 21.

Referring to FIGS. 21-23, the irons of the present invention can include forged irons with an undercut. In particular, the long irons and the mid irons 410 can include a hosel 420, a heel 412, a toe 414 a topline 422 and a sole 424. For improved weight distribution and feel, the forged iron includes an undercut 440 and the back surface of the face can have a center portion 448 that is thicker than a perimeter face portion 450. Referring in particular to FIG. 22, the iron body 411 can be forged with a hosel 420 and a solid face stabilizing bar 438. After the body 411 is forged, an aperture can be machined into the face stabilizing bar extending from a heel side 412 toward the toe side 414. As shown, it is preferred that a portion of the face stabilizing bar remain against the face portion 438(*a*) and at the back portion 438(*b*). A toe weight 432 can be formed of a low density tungsten so that it can be welded to the body, or as shown, a weight cup 452 can be used to hold a high density weight member 432 and the weight cup 452 can be welded to the body 411 toe portion. A back panel 454 can be welded to the body 411 and the back portion of the face stabilizing bar 438(*b*) to form an undercut cavity in the iron. Preferably, the thickness of the back panel 454 is approximately the same as the thickness of the back portion of the face stabilizing bar 438(*b*). It should also be noted that the back panel 454 and the weight cup 452 can be formed as a single piece. In a preferred embodiment, the iron body 411 is formed of carbon steel so that it provides a soft feel and the hosel 420 is bendable and the weight cup 452 and the back panel 454 are formed of stainless steel for durability. Preferably, the short irons of the present invention are forged solid with no undercut as set forth in FIG. 3, for example.

FIG. 23 is a cross-sectional view through the face center of the iron in FIG. 21. As shown, the face of the iron has a first thickness in a mid face region 448, a second thickness in the perimeter face portion 450 that is less than the first thickness and a third thickness in the lower face portion 449 that is thicker than the first thickness. The face portion of the face stabilizing bar 438(*a*) extends from the back of the face by about 1 mm or more. Preferably, the face portion of the face stabilizing bar extends from the heel side 412 toward the toe side 414 and forms an angle α of between about 10 and 60 degrees with the topline. Also, the face stabilizing bar forms a second angle β with the ground plane when the club is at a proper address position that is between about 5 and 45 degrees. Still further, Table IV below provides exemplary, non-limiting dimensions for various measurements of golf clubs according to an Example of the invention.

TABLE IV

| | Club Number | | | | | | | | |
|---|---|---|---|---|---|---|---|---|---|
| | 3 | 4 | 5 | 6 | 7 | 8 | 9 | P | W |
| loft | 21 | 24 | 27 | 30 | 34 | 38 | 42 | 46 | 50 |
| CG-Yg | 18.35 | 18.34 | 18.37 | 18.31 | 18.34 | 18.33 | 18.53 | 18.5 | 18.5 |
| CG-Zth | −9.48 | −10.25 | −10.93 | −11.5 | −12.24 | −13.34 | −14.33 | −15.2 | −16.31 |
| CG-Xfc | 0 | 0 | 1.15 | 1.18 | 2.28 | 2.92 | 3.12 | 3.55 | 4.1 |
| MOI-X | 48.44 | 50.19 | 52.14 | 53.5 | 56.55 | 59.72 | 62.95 | 67.22 | 72.82 |
| MOI-Y | 253.7 | 259.6 | 259.6 | 263.6 | 265.9 | 259.4 | 262.2 | 274 | 283.1 |
| MOI-Z | 285 | 290.6 | 290.6 | 294.1 | 295.6 | 286.6 | 285.7 | 293.9 | 296.8 |
| MOI-SA | 629.3 | 642.4 | 631.8 | 641 | 633.1 | 625.5 | 631.4 | 633.3 | 630.4 |

Referring to the data above, in the irons according to the present invention the center of gravity is located a distance away from the face center CG-Xfc in a manner that is significantly different than with prior art golf clubs. The face center is defined as the location that is in the middle of the scorelines and half way between the leading edge and the topline of the club. In the irons according to the present invention, the CG-Xfc for the short irons are substantially further away from the face center than the long irons. More particularly, in the inventive example above, the CG-Xfc remains approximately constant at face center through the long irons and then slightly toward the hosel in the mid-irons. All of the long irons (3 and 4) have a CG-Xfc that is within 10% of each other. The mid irons are divided into the 5 and 6 irons that have a CG-Xfc that is within 10% of each other and the 7 iron that has a CG-Xfc that is substantially juxtaposed between the 5 and 6 iron and the short irons. The short irons (8-W) have CGs that are substantially closer to the hosel or, in other words, substantially further away from the face center in the x (horizontal) direction. In fact, all of the example short irons have a CG-Xfc that is at approximately 3 mm or more from the face center. Preferably, all of the short irons according to the invention have a CG-Xfc that is at least 2.5 mm greater than the long irons and 1.5 mm greater than at least some of the mid irons.

Figure 24:
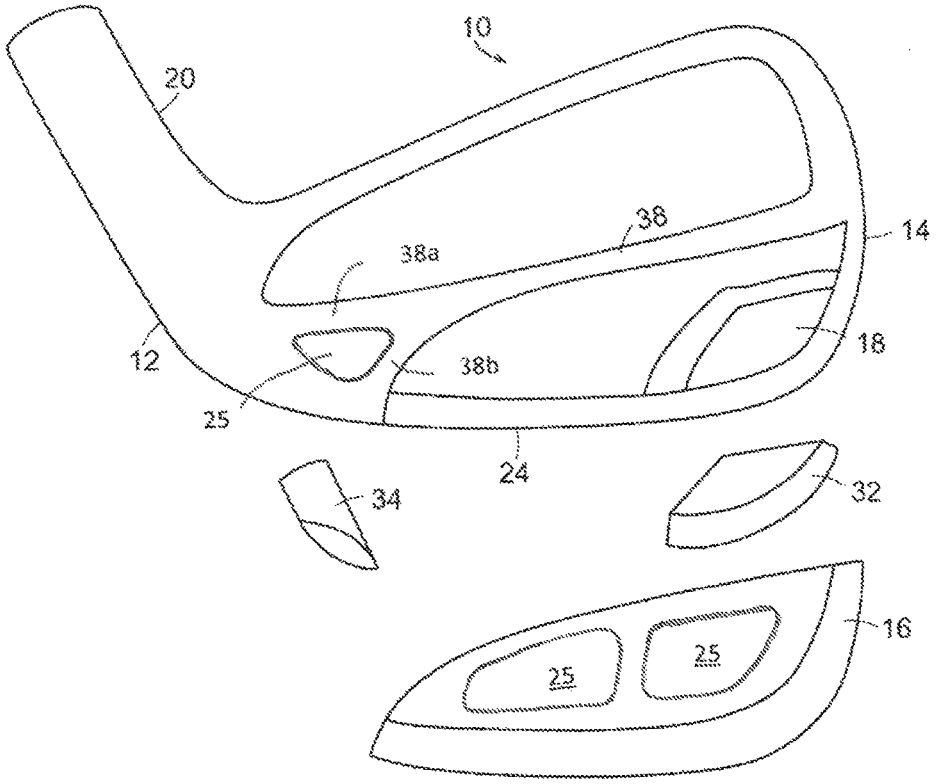
FIG. 24 is an exploded back view of an iron according to another embodiment of the present invention.

FIG. 24 is an exploded view of the components forming the iron 10 that is similar to the iron shown in FIGS. 1 and 8. The iron is a part of the set having the same properties as set forth above. Preferably, this is a long iron construction and mid iron construction within the set and is formed by forging the body 10, including a weight pocket 18 adjacent the toe section 14. After the body 10 is formed, an aperture can be formed in the sole 24, near the heel 12, such that a weight insert 32 can be securely fastened therein by a press fit, welding or adhesive. After the toe weight 32 is attached in the weight pocket 18, a back panel 16 can be secured to the body 10. Preferably, the back panel 16 and the body 10 are formed from the same materials such that they can be welded together.

In this embodiment, the back panel 16 and the heel portion of the body 10 below the face stabilizing bar have a plurality of apertures 25 formed therein. More preferably, the iron has at least three apertures, including a first aperture closest to the heel 12, a second aperture closest to the toe 14 and a third, middle aperture therebetween. The aperture 25 closest to the heel 12 can be formed directly into the body by forging or machining and can be located to expose the heel weight member 34 and/or can be formed to create a Y-shaped face stabilizing bar as shown comprising sections 38, 38*a* and 38*b*. Preferably, the section 38*b* extends from the sole 24 toward the center of the face stabilizing bar 38 and provides further structural support for the face. Preferably, both ends of the angular section 38*b* will be closer to the club head center of gravity for club heads having greater loft. More specifically, the downward extending portion 38*b* will be coupled to the sole 24 at a first end and to the face stabilizing bar 38 at a second end and both of these points will be located closer to the center of gravity for the mid irons than it is for the long irons. The middle aperture 25 and the most toeward aperture 25 are preferably each greater in area than the heelward aperture 25 and are preferably formed in the back panel 16 through a stamping process or by machining. Preferably, the plurality of apertures 25 form between 25 percent and 75 percent of the back wall area between the face stabilizing bar 38 and the sole 24. In a preferred embodiment of the set, the area of center aperture 25 is smaller for the mid irons than for the long irons. Also, the toe aperture 25 area is larger and the bottom edge is lower, closer to the sole, for the long irons than for the toe aperture for the mid irons.

Figure 25:
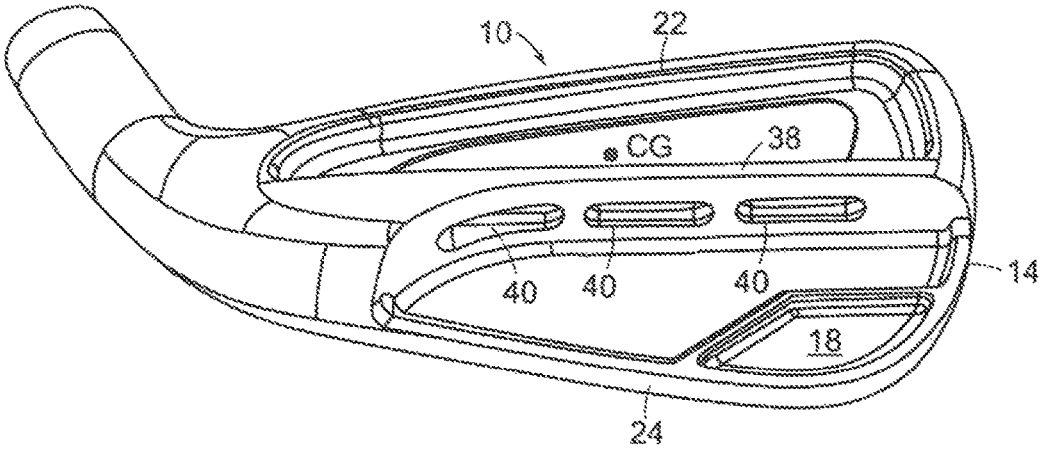
FIG. 25 is a perspective view of a portion of an iron according to another embodiment of the present invention.

Yet another way to create an iron having the CG and properties according to the present invention is to form long irons and mid irons having a body 10 as shown in FIG. 25. The head body 10 can be formed by forging the body with a topline 22, sole portion 24, toe portion 14, heel portion 12, a weight pocket 18 and a face stabilizing bar 38. If the body 10 is forged, a plurality of apertures 40 can be formed in the face stabilizing bar 38 prior to the attachment of the back panel 16. Preferably, the apertures are machined into the face stabilizing bar 38. If the body is cast, the apertures 40 can be formed in the casting and machining can be avoided. Preferably, the apertures 40 extend through the face stabilizing bar 38. The apertures 40 can extend longitudinally, from the heel 12 to the toe 14, a combined distance of greater than about 25 percent and less than about 90 percent of the length of the face stabilizing bar 38. Preferably, the apertures 40 extend through the face stabilizing bar 38 to form a plurality of rib members extending form a face portion of the face stabilizing bar to a back portion of the face stabilizing bar. In a preferred set, the combined length of the apertures 40, in the heel to toe direction, has a first aperture length for the long irons. The mid irons have a second aperture length that is shorter than the first aperture length.

Figure 26:
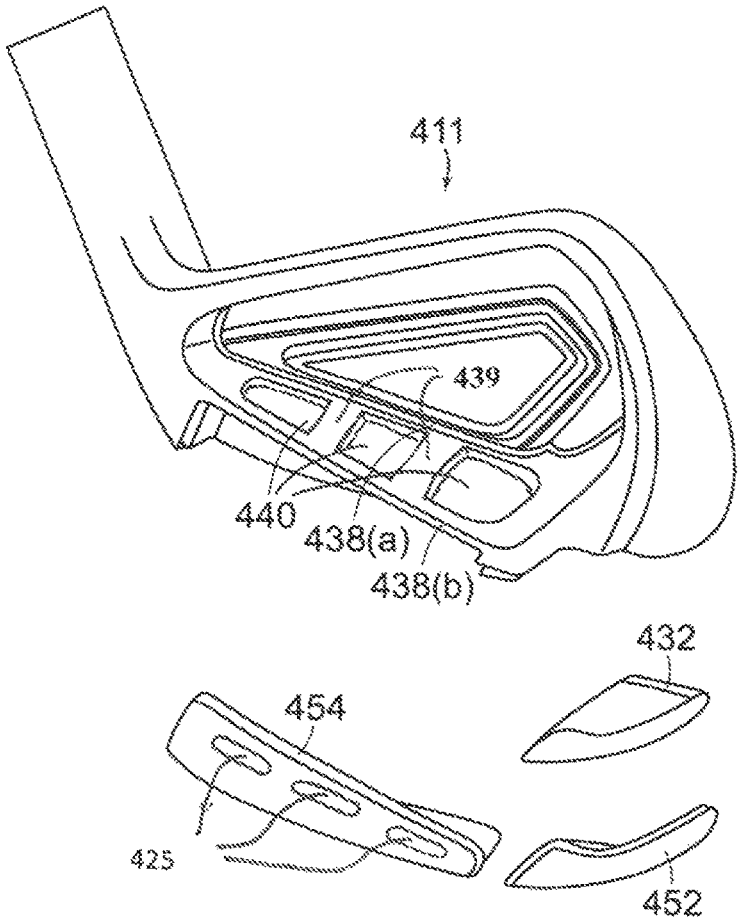
FIG. 26 is an exploded perspective view of an iron according to another embodiment of the present invention.

Referring to FIG. 26, the long irons and the mid irons 410, forming a set according to the present inventions, can include a hosel 420, a heel 412, a toe 414 a topline 422 and a sole 424. For improved weight distribution and feel, the irons can be forged and include a plurality of apertures 440 in the face stabilizing bar 438 and a plurality of apertures 425 in the back wall 454. The iron body 411 can be forged with a hosel 420 and a solid face stabilizing bar 438. After the body 411 is forged, a plurality of apertures 440 can be machined into the face stabilizing bar extending from a heel side 412 toward the toe side 414. As shown, it is preferred that a portion of the face stabilizing bar remain against the face portion 438(*a*) and at the back portion 438(*b*) and ribs 439 extend therebetween. A toe weight 432 can be formed of a low-density tungsten (13-15 g/cc) so that it can be welded to the body, or as shown, a low-density tungsten weight cup 452 can be used to hold a high-density tungsten (16-17 g/cc) weight member 432 and the weight cup 452 can be welded to the body 411 toe portion. A back panel 454 can be welded to the body 411 and the back portion of the face stabilizing bar 438(*b*) to form a cavity with ribs 439 in the iron. Preferably, the thickness of the back panel 454 is approximately the same as the thickness of the back portion of the face stabilizing bar 438(*b*). It should also be noted that the back panel 454 and the weight cup 452 can be formed as a single piece.

The apertures in 440 in the face stabilizing bar 438 preferably comprise about 25 percent to 75 percent of the face stabilizing bar top planar area and the apertures 425 in the back panel 454 preferably comprise between about 25 percent and 90 percent of the back panel 454 back area, the area from the heel to the toe and the face stabilizing bar to the sole portion. Within the set, the combined area of the apertures in the back panel of the long irons is preferably greater than the combined area of the apertures in the mid irons. More preferably, the combined area of the apertures in the back panel of the long irons is at least 10 percent greater than the combined area of the apertures in the mid irons.

In a preferred embodiment, the iron body 411 is formed of carbon steel so that it provides a soft feel and the hosel 420 is bendable and the weight cup 452 and the back panel 454 are formed of stainless steel for durability. Preferably, the short irons of the present invention are forged solid with no undercut as set forth in FIG. 3, for example.

Still further, Table IV above provides exemplary, non-limiting dimensions for various measurements of golf clubs according to this Example of the invention.

Still further, the distance of the center of gravity to the ground CG-Yg remains substantially the same for the golf clubs in the set according to the present invention and is preferably less than 19 mm through the set.

Another aspect of the preferred embodiment of the present invention is to have a consistent feel within the set. Thus, the swing weights of the irons may be constant through the set. Furthermore, the distance from the center of gravity to the shaft axis can be approximately constant through the set or progress through the set inversely to the loft.

While it is apparent that the illustrative embodiments of the present invention disclosed herein fulfill the objectives stated above, it is appreciated that numerous modifications and other embodiments may be devised by those skilled in the art. Therefore, it will be understood that the appended claims are intended to cover all modifications and embodiments which would come within the spirit and scope of the present invention.

What is claimed is:

1. A set of golf clubs comprising at least a first golf club, a second golf club, and a third club, wherein:

the first, second and third golf clubs each comprising a heel, a toe, a topline, a hosel, a sole and a front face having a face center, the first golf club further comprising a first loft angle ($LA_1$) of between 15 and 25 degrees having a first face stabilizing bar extending from the heel to the toe, a first back panel coupled to the first face stabilizing bar, and a first center of gravity positioned horizontally from the face center by a first distance, the second golf club comprising a second loft angle ($LA_2$) of between 26 and 36 degrees and a second center of gravity positioned horizontally from the face center by a second distance, and the third golf club comprising a third loft angle ($LA_3$) of between 37 and 47 degrees and a third center of gravity positioned horizontally from the face center by a third distance, wherein the first distance and the second distance are approximately constant and the third distance is at least 30 percent greater than the first distance and the second distance.

2. The set of golf clubs of claim 1, wherein the first golf club further comprises a plurality of first apertures formed in the first face stabilizing bar.

3. The set of golf clubs of claim 2, wherein the first face stabilizing bar has a first bar length and the first apertures have a combined length that is between 25 percent and 90 percent of the first bar length.

4. The set of golf clubs of claim 3, wherein a plurality of first ribs extend from a face portion of the first face stabilizing bar to a back portion of the first face stabilizing bar.

5. The set of golf clubs of claim 3, wherein the second golf club further comprises a second face stabilizing bar extending from the heel to the toe, a second back panel coupled to the second face stabilizing bar and a second plurality of apertures formed in the second face stabilizing bar.

6. The set of golf clubs of claim 5, wherein the second face stabilizing bar has a second bar length and the second apertures have a combined length that is between 25 percent and 90 percent of the second bar length.

7. The set of irons of claim 6, wherein the combined length of the first apertures is greater than the combined length of the second apertures.

8. The set of irons of claim 6, wherein the first golf club and the second golf club further comprise a weight pocket adjacent the toe and a weight member secured therein.

9. The set of irons of claim 8, wherein the first golf club and the second golf club further comprise a weight member adjacent the heel.

10. A set of golf clubs comprising at least a first golf club, a second golf club, and a third club, wherein:

the first, second and third golf clubs each comprising a heel, a toe, a topline, a hosel, a sole and a front face having a face center, the first golf club further comprising a first loft angle ($LA_1$) of between 15 and 25 degrees having a first face stabilizing bar extending from the heel to the toe, a first back panel coupled to the first face stabilizing bar forming at least a portion of a first back wall, and a first center of gravity positioned horizontally from the face center by a first distance, the second golf club comprising a second loft angle ($LA_2$) of between 26 and 36 degrees and a second center of gravity positioned horizontally from the face center by a second distance, and the third golf club comprising a third loft angle ($LA_3$) of between 37 and 47 degrees and a third center of gravity positioned horizontally from the face center by a third distance, wherein the first distance and the second distance are approximately constant and the third distance is at least 30 percent greater than the first distance and the second distance.

11. The set of golf clubs of claim 10, wherein the first golf club further comprises a plurality of first back apertures formed in the first back wall.

12. The set of irons of claim 11, wherein one of the first back apertures is adjacent the heel such that it makes the first face stabilizing bar Y-shaped with a portion extending from the sole toward a center of the first face stabilizing bar.

13. The set of golf clubs of claim 11, wherein the first back apertures comprise between 25 percent and 75 percent of a total area between the heel and the toe and the first face stabilizing bar and the sole.

14. The golf club set of claim 11, wherein the second golf club further comprises a second face stabilizing bar extending from the heel to the toe, a second back panel coupled to the second face stabilizing bar forming at least a portion of a second back wall and a second plurality of back apertures formed in the second back wall.

15. The set of irons of claim 10, where in the first golf club includes at least three apertures in the first back wall with an aperture closest to the heel having an area that is less than an area of the other apertures.

16. A set of golf clubs comprising at least a first golf club, a second golf club, and a third club, wherein:

the first, second and third golf clubs each comprising a heel, a toe, a topline, a hosel, a sole and a front face having a face center, the first golf club further comprising a first loft angle ($LA_1$) of between 15 and 25 degrees having a first face stabilizing bar extending from the heel to the toe having a first plurality of face stabilizing bar apertures, a first back panel coupled to the first face stabilizing bar forming at least a portion of a first back wall having a first plurality of back wall apertures, and a first center of gravity positioned horizontally from the face center by a first distance, the second golf club comprising a second loft angle ($LA_2$) of between 26 and 36 degrees and a second center of gravity positioned horizontally from the face center by a second distance, and the third golf club comprising a third loft angle ($LA_3$) of between 37 and 47 degrees and a third center of gravity positioned horizontally from the face center by a third distance, wherein the second golf club further comprises a second face stabilizing bar extending from the heel to the toe having a second plurality of face stabilizing bar apertures, a second back panel coupled to the second face stabilizing bar forming at least a portion of the second back wall having a second plurality of back wall apertures, and wherein the first back wall apertures have a first area and the second back wall apertures have a second area less than the first area.

17. The set of golf clubs of claim 16, wherein the first plurality of face stabilizing bar apertures comprise about 25 percent to 75 percent of a top area of the first face stabilizing bar and the second plurality of face stabilizing bar apertures comprise about 25 percent to 75 percent of a top area of the second face stabilizing bar.

18. The set of golf clubs of claim 16, wherein the first plurality of back wall apertures comprise between about 25 percent and 90 percent of a back area of the first back wall and the second plurality of back wall apertures comprise between about 25 percent and 90 percent of a back area of the second back wall.

* * * * *